US011066896B2

(12) United States Patent
Heiman et al.

(10) Patent No.: US 11,066,896 B2
(45) Date of Patent: Jul. 20, 2021

(54) EXPANDABLE BACKUP RING

(71) Applicant: Parker-Hannifin Corporation, Cleveland, OH (US)

(72) Inventors: Timothy David Heiman, Warsaw, IN (US); James Richard Hanson, Fort Wayne, IN (US); William Brooks Frederick, Winona Lake, IN (US)

(73) Assignee: Parker-Hannifin Corporation, Cleveland, OH (US)

( * ) Notice: Subject to any disclaimer, the term of this patent is extended or adjusted under 35 U.S.C. 154(b) by 87 days.

(21) Appl. No.: 16/093,744

(22) PCT Filed: Apr. 14, 2017

(86) PCT No.: PCT/US2017/027639
§ 371 (c)(1),
(2) Date: Oct. 15, 2018

(87) PCT Pub. No.: WO2017/184449
PCT Pub. Date: Oct. 26, 2017

(65) Prior Publication Data

US 2019/0360297 A1 Nov. 28, 2019

Related U.S. Application Data

(60) Provisional application No. 62/323,978, filed on Apr. 18, 2016.

(51) Int. Cl.
*E21B 33/12* (2006.01)
*E21B 33/128* (2006.01)

(52) U.S. Cl.
CPC ..... *E21B 33/1216* (2013.01); *E21B 33/128* (2013.01)

(58) Field of Classification Search
CPC ..... E21B 33/1216; E21B 33/128
(Continued)

(56) References Cited

U.S. PATENT DOCUMENTS 3,298,440 A 1/1967 Current
3,381,969 A * 5/1968 Crow ..... E21B 33/1216 277/340

(Continued)

FOREIGN PATENT DOCUMENTS

WO WO 2017120188 7/2017

OTHER PUBLICATIONS

"align" definition available from https://www.thefreedictionary.com/align (Year: 2020).*

(Continued)

*Primary Examiner* — Blake E Michener
*Assistant Examiner* — Theodore N Yao
(74) *Attorney, Agent, or Firm* — Renner, Otto, Boisselle & Sklar, LLP

(57) ABSTRACT

A radially expandable backup ring (50) with relatively rigid segments (56) and relatively resilient segments (58) that are integral with one another to circumferentially urge the relatively rigid segments (56) together when the backup ring (50) expands. The backup ring (50) may radially expand to reduce or eliminate a radial gap between the backup ring (50) and a radially inwardly facing surface of a corresponding cased wellbore (22) to prevent or minimize axial extrusion of a corresponding sealing member (32), such as a compressible packer seal of a cased-hole retrievable packer assembly. The relatively resilient segments (58) allow the backup ring (50) to elastically expand and retract to prevent axial extrusion of the sealing member (32). The relatively rigid support segments (54) may be axially aligned with a corresponding relatively resilient segment (58) of the (Continued)

backup ring to prevent axial extrusion of the sealing member (32) through the corresponding relatively resilient segment (58).

20 Claims, 18 Drawing Sheets

(58) Field of Classification Search
USPC ..... 277/638
See application file for complete search history.

(56) References Cited

U.S. PATENT DOCUMENTS 3,897,038 A * 7/1975 Le Rouax ..... E21B 33/062 251/1.2
3,960,311 A * 6/1976 Griffiths ..... B23K 37/0531 228/49.3
4,379,558 A * 4/1983 Pippert ..... E21B 33/1216 277/536
5,311,938 A 5/1994 Hendrickson
5,701,959 A * 12/1997 Hushbeck ..... E21B 33/1216 166/118
6,142,227 A 11/2000 Hiorth
6,976,534 B2 12/2005 Sutton
8,191,625 B2 6/2012 Porter
8,276,678 B2 * 10/2012 Burnett ..... E21B 33/1216 166/387
8,327,929 B2 12/2012 Reid
8,393,388 B2 3/2013 Bishop
8,701,787 B2 4/2014 Shkurti
9,464,498 B2 * 10/2016 Hiorth ..... E21B 33/1216
2001/0045746 A1 * 11/2001 Russell ..... F16J 15/028 285/105
2002/0043368 A1 4/2002 Bell et al.
2006/0290066 A1 * 12/2006 Hiorth ..... E21B 33/1208 277/322
2012/0217025 A1 * 8/2012 Shkurti ..... E21B 33/1216 166/387
2013/0147120 A1 * 6/2013 O'Malley ..... E21B 33/1216 277/336
2014/0262351 A1 9/2014 Derby
2017/0191340 A1 7/2017 Deng
2018/0023366 A1 1/2018 Deng
2019/0040710 A1 * 2/2019 Deng ..... E21B 33/128
2019/0078413 A1 * 3/2019 Kendall ..... E21B 33/128

OTHER PUBLICATIONS

"axis" definition available from https://www.thefreedictionary.com/axis (Year: 2020).*
International Search Report and Written Opinion of PCT/US2017/027639 dated Oct. 13, 2017, 12 pages.

* cited by examiner

EXPANDABLE BACKUP RING

RELATED APPLICATIONS

This application is a national stage application pursuant to 35 U.S.C. § 371 of PCT/US2017/027639 filed on Apr. 14, 2017 and published in the English language, which claims the benefit of U.S. Provisional Application No. 62/323,978 filed Apr. 18, 2016, which is incorporated herein by reference.

FIELD OF INVENTION

The present invention relates generally to backup rings, and more particularly to expandable backup rings for extrusion prevention of seals for downhole packers and bridge plugs.

BACKGROUND

Downhole packers and bridge plugs are sealing devices that isolate and contain fluid under substantial pressures within an oil wellbore. Downhole packers may include a packing-element system and may be set by hydraulic, mechanical, or explosive forces. Axial compression force may energize the packing-element system and create a seal by radially expanding a packer-element of the packing-element system. The packer-element may be released by unsetting the packer-element system.

The downhole packer may include an elastomer that swells when exposed to various fluids. The swellable packer relies on fluid absorption into the elastomer to expand the packing-element system to an inner diameter of the wellbore. The amount of elastomer swell is dependent on the formulation of the elastomer, the fluid it is exposed to, and the time and temperature of the exposure.

While the packer-element system is set, high pressure may cause the packer-element to axially extrude into gaps between the downhole packer and the wellbore. Axial extrusion of a packer-element during use can result in degradation of the packer-element and loss of sealing force. Retrieval and reuse of the packer-element can also be impacted due to deformation of the packer-element that prevents or impedes radial retraction of the packer-element.

SUMMARY OF INVENTION

The present invention provides a radially expandable backup ring with relatively rigid segments and relatively resilient segments that are integral with one another to circumferentially urge the relatively rigid segments together when the backup ring expands. The backup ring may radially expand to reduce or eliminate a radial gap between the backup ring and a radially inwardly facing surface of a corresponding cased wellbore to prevent or minimize axial extrusion of a corresponding sealing member, such as a compressible packer seal of a cased-hole retrievable packer assembly. The relatively resilient segments allow the backup ring to elastically expand and retract, which may prevent axial extrusion of the sealing member and may allow the sealing member to be retrieved from the wellbore.

The relatively rigid support segments may be axially aligned with a corresponding relatively resilient segment of the backup ring to prevent axial extrusion of the sealing member through the corresponding relatively resilient segment.

The backup ring may be assembled quickly and easily with a corresponding tool compared to previous anti-extrusion devices. For example, the backup ring may be a single integral component that slides over a shaft of the tool. In an embodiment, the backup ring may be one-piece, which can further reduce assembly time of the backup ring onto the shaft.

The backup ring may be relatively smaller than previous anti-extrusion devices intended to prevent axial extrusion of packer seals, which may result in reduced material costs and weight. For example, the axial thickness of the backup ring may be significantly less than the axial thickness of the packer seal, which may result in a minimal amount of material required to manufacture the backup ring.

Compared to previously known complex backup systems, the backup ring may be relatively inexpensive to assemble in view of the relatively simplistic assembly needed, and may be relatively inexpensive to manufacture in view of the backup ring's reduced material costs, reduced weight, and the relatively simple manufacturing complexity. For example, the backup ring may be made using a standard manufacturing technique, such as machining and cutting (e.g., by waterjet, laser or electrical discharge machining).

The backup ring assembly may include a dual layer support segment assembly. The dual layer support segment assembly may reduce or eliminate exposure of the backup ring to direct axial force from the packer seals, particularly axial force against the relatively resilient segments of the backup ring. Reducing or eliminating direct axial force allows the cumulative circumferential length of the relatively resilient segments to be increased and allows the cumulative circumferential length of the relatively rigid segments to be reduced. The increased circumferential length of the relatively resilient segments allows the percentage of radial expansion, from the unexpanded state of the backup ring to the expanded state, to increase.

The backup ring may be surface treated to reduce friction and/or to protect against corrosion. For example, nitrocarburizing case hardening treatments, such as quench polish quench, are able to reduce friction and protect against corrosion.

The backup ring may include a radially outer chamfer to allow easier removal of the backup ring from the cased wellbore, such as when the backup ring remains in an expanded or partially expanded state.

According to one aspect of the invention, a radially expandable backup ring includes a plurality of relatively rigid segments that are circumferentially arranged around a longitudinal axis, a plurality of relatively resilient segments that are circumferentially arranged around the longitudinal axis and are each alternately disposed with respect to each relatively rigid segment, wherein the relatively rigid segments and the relatively resilient segments together circumscribing the longitudinal axis, and wherein each relatively rigid segment has a radially inner surface that faces the longitudinal axis, a radially outer surface that faces away from the longitudinal axis, a first axially facing surface, and a second axially facing surface that faces away from the first axially facing surface, the radially inner surfaces at least partially define an axial through hole that extends along the longitudinal axis, each of the relatively resilient segments resiliently connects a pair of adjacent relatively rigid segments, each relatively resilient segment extends circumferentially between the corresponding pair of adjacent relatively rigid segments to resiliently expand circumferentially when the relatively rigid segments are moved radially outwardly to expand the backup ring, thereby circumferentially urging together adjacent relatively rigid segments with the relatively resilient segments.

The foregoing and other features of the invention are hereinafter described in greater detail with reference to the accompanying drawings.

DETAILED DESCRIPTION

The principles of this present application have particular application to preventing axial extrusion of mechanically energized packer-elements that expand radially to prevent high pressure fluid from passing between an oil-well tool assembly and an inner surface of a cased wellbore, and thus will be described below chiefly in this context. It will be appreciated that principles of this invention may be applicable to other assemblies where it is desirable to prevent axial extrusion of a component.

Figure 1:
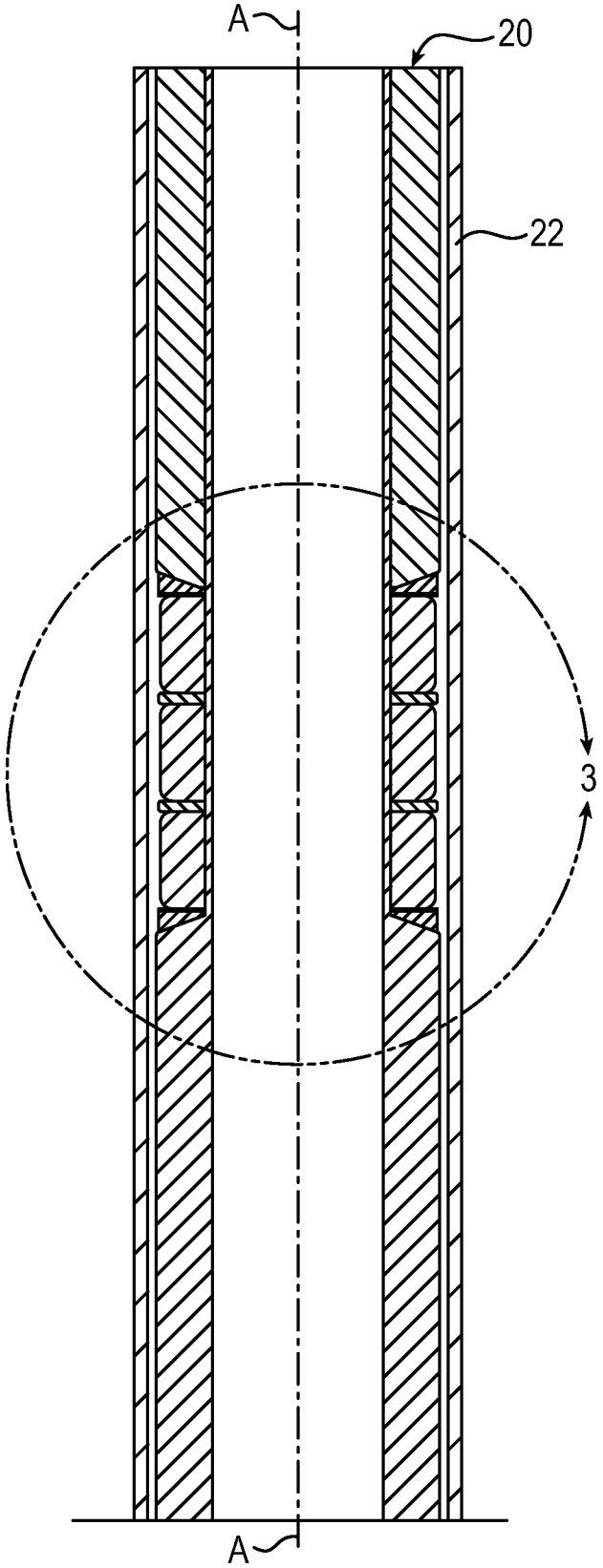
FIG. 1 is a side cross-sectional view of an exemplary tool assembly including two exemplary backup ring assemblies inside a cased wellbore.
Figure 2:
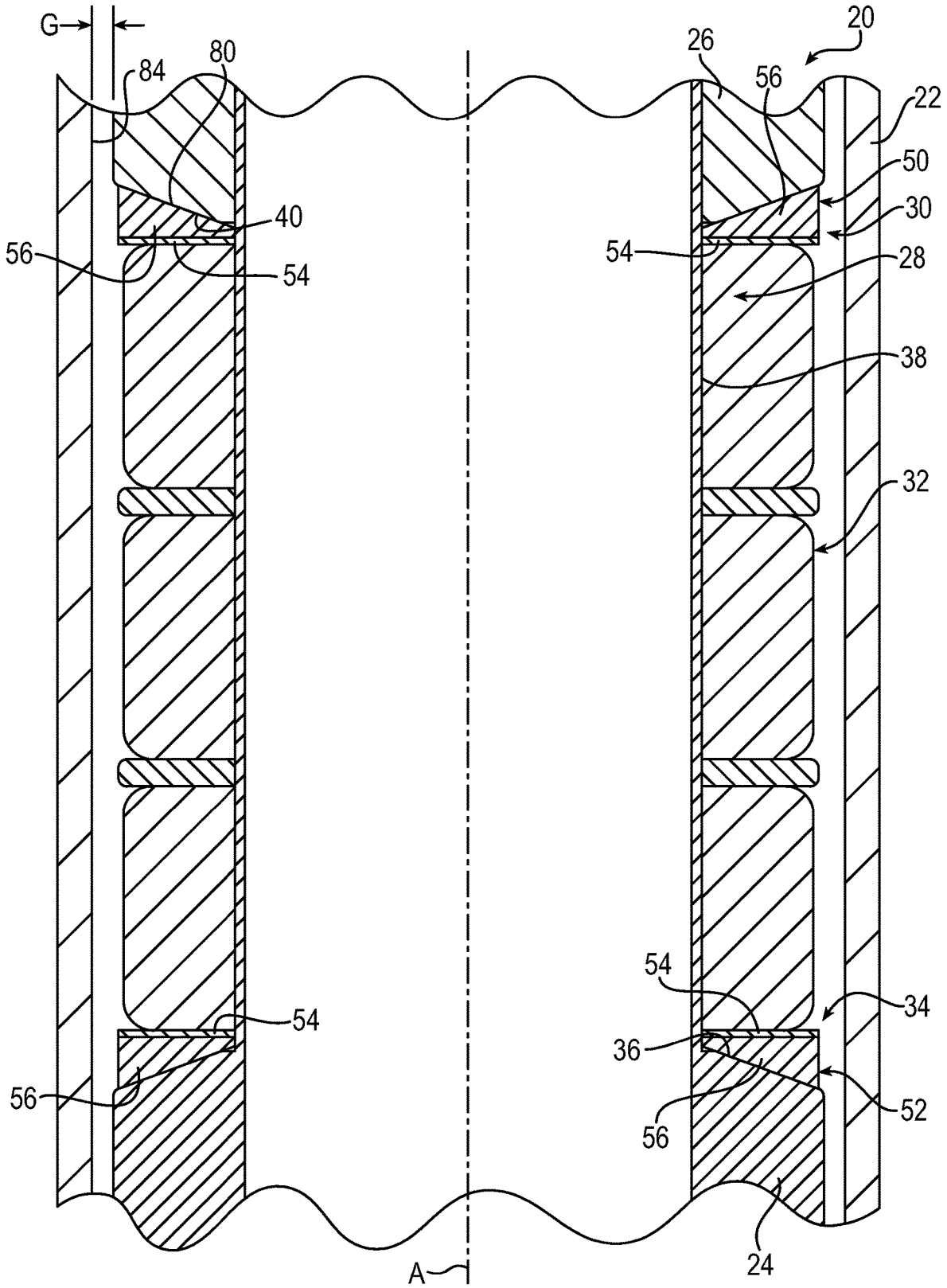
FIG. 2 is a partial view of the side cross-sectional view of the cased wellbore and the tool assembly of FIG. 1 in the unexpanded state.
Figure 3:
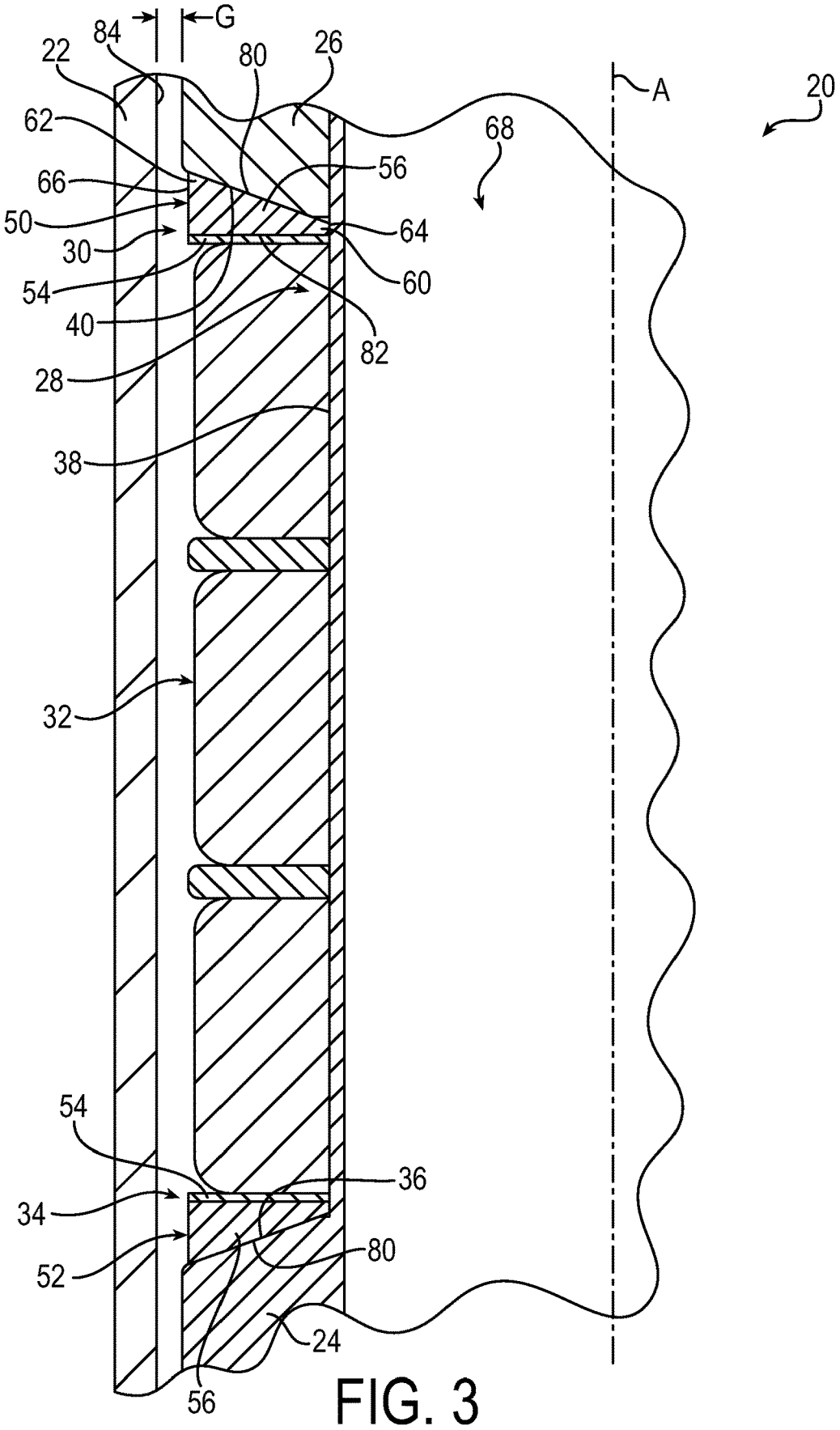
FIG. 3 is a partial side cross-sectional view of the cased wellbore and the tool assembly of FIG. 2 in the unexpanded state.

Referring now in detail to the drawings, and initially to FIGS. 1-3, a tool assembly is designated generally by reference numeral 20 and illustrated inside of a cased wellbore 22. The tool assembly 20 may be a cased-hole retrievable packer assembly, as illustrated, or may be another suitable tool assembly.

Referring now to FIGS. 2 and 3, the tool assembly 20 may include an inner mandrel 24 and an outer mandrel 26 that together form a radially outwardly facing groove 28 that may seat a first backup ring assembly 30, a sealing member 32, and a second backup ring assembly 34. The inner mandrel 24 and/or the outer mandrel 26 may be axially movable relative to the other to reduce an axial thickness of the radially outwardly facing groove 28. For example, the outer mandrel 26 may be slidable from a neutral state to an axially reduced state (shown in FIGS. 4 and 5).

The inner mandrel 24 may include a first axially-facing mandrel surface 36 and a radially outwardly facing surface 38. The first axially-facing mandrel surface 36 may extend radially in an inclined manner relative to a longitudinal axis A to form an inclined camming surface that is engageable with a camming surface of the corresponding backup ring assembly 34. In an embodiment, the first axially-facing mandrel surface is formed by a conical end ring, such as a shoe.

The outer mandrel 26 may include a second axially-facing mandrel surface 40 that may circumscribe the longitudinal axis A and may be axially movable relative to the first axially-facing mandrel surface 36. The second axially-facing mandrel surface 40 may extend radially in an inclined manner relative to the longitudinal axis A to form an inclined camming surface that is engageable with a camming surface of the corresponding backup ring assembly 30. In an embodiment, the first axially-facing mandrel surface is axially movable relative to the second axially-facing mandrel surface, or both are movable relative to one another. In an embodiment, the second axially-facing mandrel surface is formed by a conical end ring, such as a shoe.

Together, the first axially-facing mandrel surface 36, the radially outwardly facing surface 38, and the second axially-facing mandrel surface 40 may form the radially outwardly facing groove 28. For example, the radially outwardly facing surface 38 may extend axially from the first axially-facing mandrel surface 36 to the second axially-facing mandrel surface 40. In an embodiment, the first axially-facing mandrel surface and the radially outwardly facing surface are made of two separate bodies.

The first backup ring assembly 30, the sealing member 32, and the second backup ring assembly 34 may each circumscribe the radially outwardly facing surface 38 and may be disposed at least partially within the radially outwardly facing groove 28. For example, when in an unexpanded state, a radially outermost extent of each of the first backup ring assembly 30, the sealing member 32, and the second backup ring assembly 34 may be radially inward of a radially outermost extent of the first axially-facing mandrel surface 36 and the second axially-facing mandrel surface 40.

The sealing member 32 may be axially sandwiched between the first backup ring assembly 30 and the second backup ring assembly 34. For example, the sealing member 32 may be a compressible packer-element, such as a three-stack packer-element, that is compressible between the first backup ring assembly 30 and the second backup ring assembly 34. In an embodiment, the sealing member includes more than three packer-elements or less than three packer-elements.

The first and second backup ring assemblies 30 and 34 may each include a backup ring 50 or 52 and a plurality of relatively rigid support segments 54 that are circumferentially arranged around the longitudinal axis A. The backup ring assemblies 30 and 34 may be identical to one another and reversely oriented.

Figure 6:
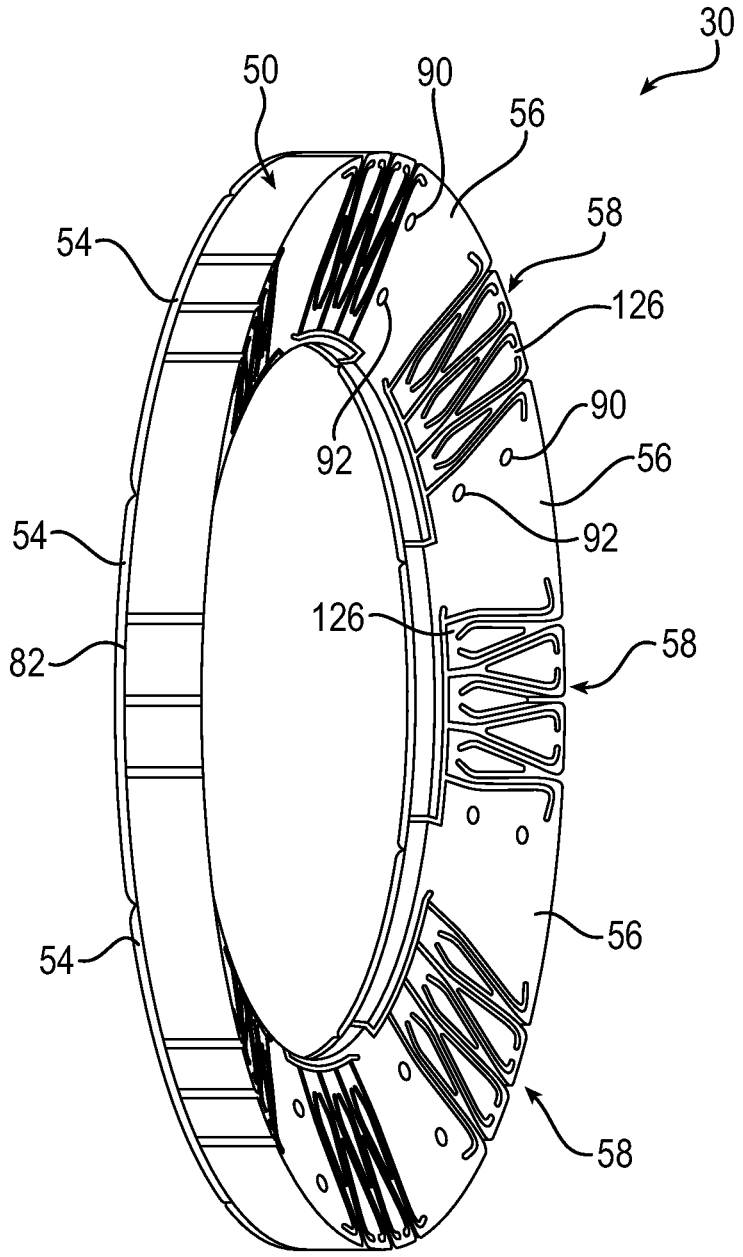
FIG. 6 is an oblique view of an exemplary radially expandable backup ring of one of the backup ring assemblies of FIG. 1.

Referring briefly to FIG. 6, each backup ring 50 may include a plurality of relatively rigid segments 56 and a plurality of relatively resilient segments 58. The relatively rigid segments 56 and the relatively resilient segments 58 may be circumferentially arranged around the longitudinal axis A. Each relatively resilient segment 58 may be alternately disposed with respect to each relatively rigid segment 56. In an embodiment, the backup ring assemblies may not be identical or only one of the backup ring assemblies may be included in the tool assembly.

Referring now to FIG. 3, each relatively rigid segment 56 may include a radially inner end 60 and a radially outer end 62. For example, each relatively rigid segment 56 may have a frusto-triangular cross-section along the longitudinal axis A. In an embodiment, each relatively rigid segment has a triangular cross-section and the radially inner end forms a point. In another embodiment, the radially outer end of the rigid segment may have a flat surface that faces away from the relatively rigid support segment and extends perpendicular to the longitudinal axis.

The radially inner end 60 may form a radially inner surface 64 that faces toward the longitudinal axis A, and the radially outer end 62 may form a radially outer surface 66 that faces away from the longitudinal axis A. The radially inner surface 64 may define an axial through hole 68 that extends along the longitudinal axis A. The axial through hole 68 may be cylindrical to receive a cylindrical shaft, such as a shaft defining the radially outwardly facing surface 38 of the inner mandrel 24, to extend through the backup ring 50. The axial through hole may be another suitable shape, such as rectilinear to receive a rectilinear portion of a shaft.

The radially inner end 60 may partially form a first axially facing surface 80, and may partially form a second axially facing surface 82 that faces away from the first axially facing surface 80. The first axially facing surface 80 may extend radially in an inclined manner relative to the longitudinal axis A to form a camming surface that may face radially inwardly toward the longitudinal axis A.

The first axially facing surface 80 may receive an axial force from the outer mandrel 26 and/or from the inner mandrel 24 through the sealing member 32, and transform the axial force into a radial force. For example, the first axially facing surface 80 may receive an axially inward force and transform the axially inward force into a radially outward force to urge the relatively rigid segments 54 radially outward toward the inner surface 84 of the cased wellbore 22.

The first axially facing surfaces 80 may each extend a radial length from the radially inner surface 64 to the radially outer surface 66. The radial length from the radially inner surface 64 to the radially outer surface 66 may be less than a radial distance of the radially inner surface 84 from the longitudinal axis A.

The first axially facing surfaces 80 of the first and second backup ring assemblies 30 and 34 may abut the first axially-facing mandrel surface 36 and the second axially-facing mandrel surface 40, respectively. The abutting may allow an axial compressive force—communicated through the first axially-facing mandrel surface 36 and/or the second axially-facing mandrel surface 40 to the first axially facing surfaces 80—to be transformed into a radially outward force to urge the relatively rigid segments 56 radially outward.

The relatively rigid support segments 54 may each be axially aligned with a corresponding relatively resilient segment 58 (shown in FIG. 6) such that the relatively rigid support segments 54 may each be disposed between each relatively resilient segment 58 and the sealing member 32. For example, the relatively rigid support segments 54 may each be circumferentially arranged around the longitudinal axis A and each may be disposed between each corresponding relatively resilient segment 58 (shown in FIG. 6) and the sealing member 32.

The relatively rigid segments 56 may have a yield strength anywhere from 10 kilopounds per square inch (ksi) to 200 ksi to prevent axial deformation when subject to high loads by the sealing member 32. For example, the relatively rigid segments 56 may be made of American Iron and Steel Institute (AISI) 4140 grade steel with a 110 ksi yield strength. The relatively rigid segments may be made of any other suitable metal or composites.

The tool assembly 20 may be lowered into the cased wellbore 22 in an unexpanded state where the backup ring assemblies 30 and 34 and the sealing member 32 have a cross-sectional area less than the inner surface 84 of the cased wellbore 22. When in the unexpanded state, a radial gap G may circumscribe the longitudinal axis A and may extend between the inner surface 84 of the cased wellbore 22 and an outermost extent of the tool assembly 20 to allow the tool assembly 20 to be easily axially movable within the cased wellbore 22. For example, the radial gap G may be cylindrical and have an unexpanded radial thickness of anywhere from 0.125"-0.5". In an embodiment, the radial gap G may be cylindrical and have an unexpanded radial thickness of anywhere from 0.02"-1".

In an embodiment, the radial gap is not cylindrical. For example, the radial gap may have a hollow-rectangular cross-section taken perpendicular to the longitudinal axis.

Figure 4:
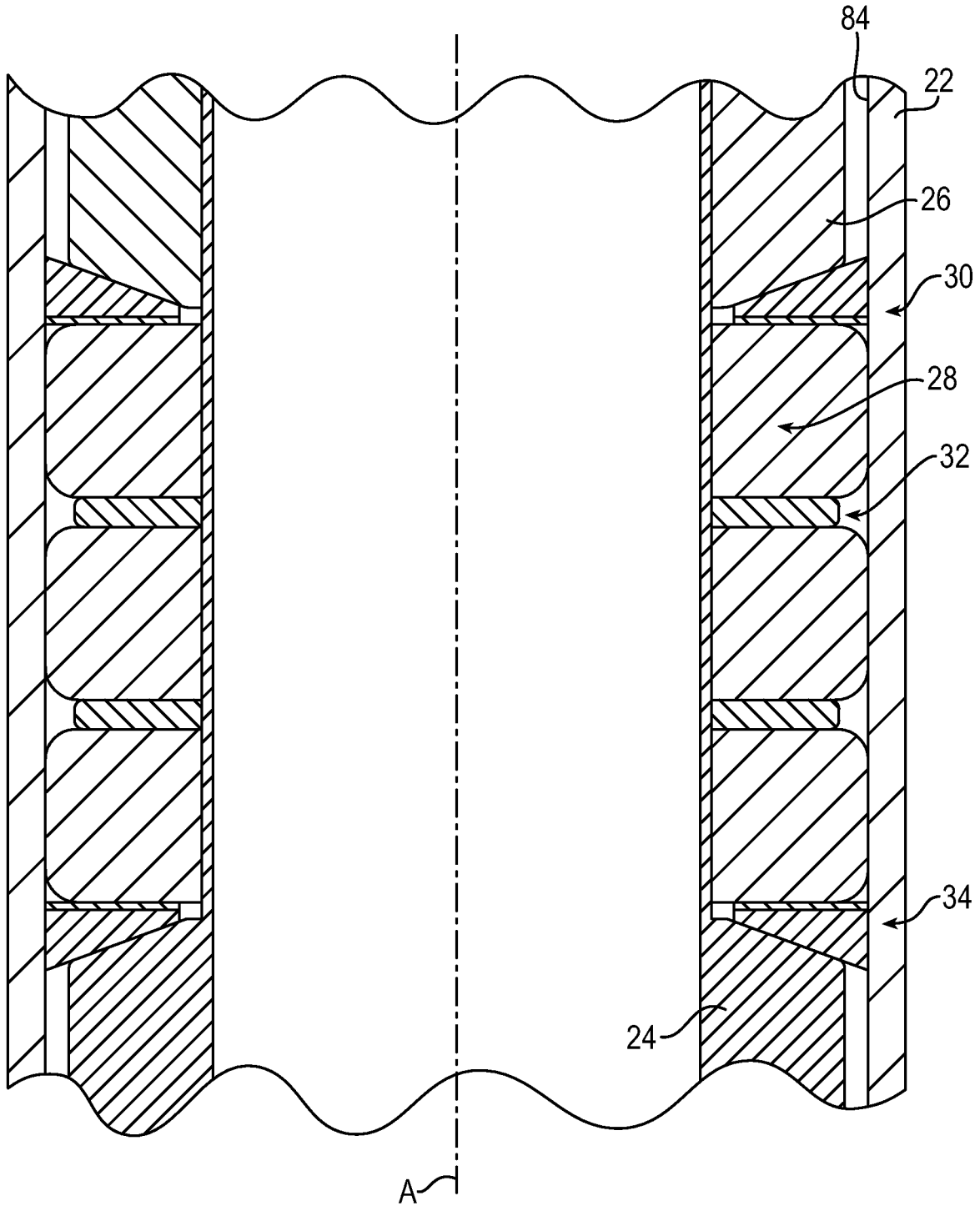
FIG. 4 is a side cross-sectional view of the cased wellbore and the tool assembly of FIG. 2 in an expanded state.
Figure 5:
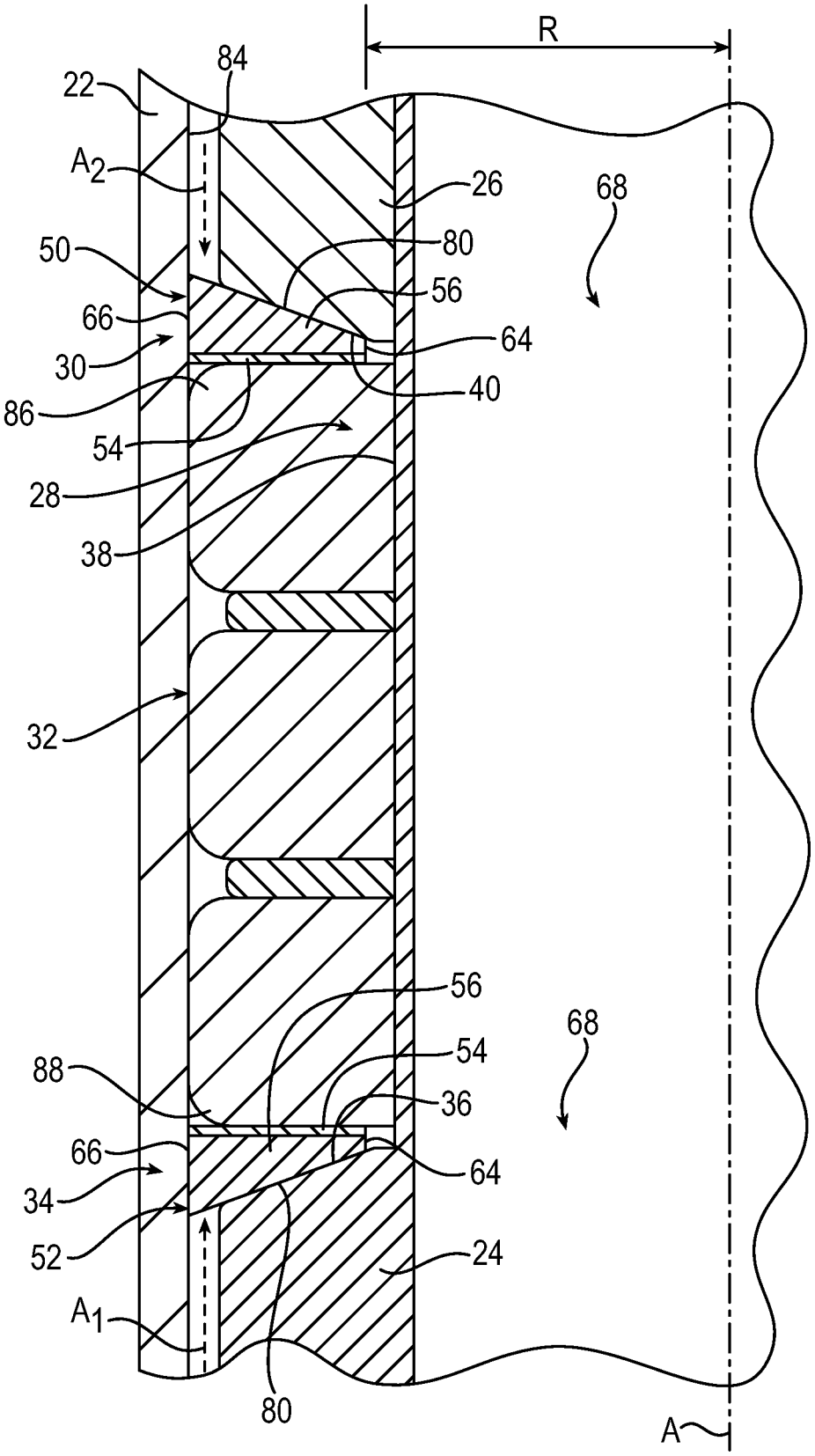
FIG. 5 is a partial side cross-sectional view of the cased wellbore and the tool assembly of FIG. 4 in the expanded state.

Referring now to FIGS. 4-5, when the axial thickness of the radially outwardly facing groove 28 is reduced the first backup ring assembly 30, the sealing member 32, and the second backup ring assembly 34 may be in an expanded state. An axial compressive force of the inner mandrel 24 and the outer mandrel 26 may axially compress the sealing member 32 into the expanded state. For example, axially compressing the sealing member 32 may cause the sealing member to radially expand to the inner surface 84 of the cased wellbore 22, which may eliminate the radial gap G (shown in FIG. 3). In an embodiment, the sealing member is expanded radially outwardly to fill the radial gap by another method or mechanism. For example, the sealing member may be a swellable packer seal.

Referring now to FIG. 5, reducing the axial thickness of the radially outwardly facing groove 28 allows the first axially-facing mandrel surface 36 and the second axially-facing mandrel surface 40 to exert axial force against the first axially facing surfaces 80 of the corresponding backup ring 50 or 52. The first axially facing surfaces 80 may each transform the axial force to move the relatively rigid segments 56 radially outward toward the inner surface 84 of the cased wellbore 22. The relatively rigid segments 56 may move radially outward until abutting the inner surface 84.

The relatively rigid support segments 54 may move radially outward with the relatively rigid segments 56. In an embodiment, the relatively rigid support segments may move independently of the relatively rigid segments. For example, the relatively rigid support segments may not be radially fixed to the corresponding relatively rigid segments.

When a relatively high pressure fluid between the inner mandrel 24 and the cased wellbore 22 urges the sealing member 32 to extrude in a first axial direction $A_1$ toward the first backup ring assembly 30. The relatively rigid segments 56 and the relatively rigid support segments 54 of the corresponding backup ring 50 may prevent a radially outer portion 86 of the sealing member 32 from extruding axially in the first axial direction $A_1$. Preventing extrusion may reduce permanent deformation of the sealing member 32, which may increase sealing performance, retrieval, and/or reuse of the sealing member 32.

When a relatively high pressure fluid between the outer mandrel 26 and the cased wellbore 22 urges the sealing member 32 to extrude in a second axial direction $A_2$ toward the second backup ring assembly 34. The relatively rigid segments 56 and the relatively rigid support segments 54 may prevent a radially outer portion 88 of the sealing member 32 from extruding axially in the second direction $A_2$. Preventing extrusion may reduce permanent deformation of the sealing member 32, which may increase sealing performance, retrieval, and/or reuse of the sealing member 32.

While the relatively rigid segments 56 are in an initial radially inward position (as shown in FIG. 1), each radially inner surface 64 may engage the radially outwardly facing surface 38 of the inner mandrel 24. When each of the relatively rigid segments 56 are moved radially outwardly from the initial radially inward position a cross-sectional area of the corresponding axial through hole 68 taken lateral to the longitudinal axis A may increase. For example, a radius R of the axial through hole 68 may increase when the relatively rigid segments 56 move radially outward. While the cross-sectional area is increased, each radially inner surface 64 may be spaced from the radially outwardly facing surface 38.

While moving the relatively rigid segments 56 radially outwardly, the radially outer surface 66 of each of the relatively rigid segments 56 may move radially outwardly toward the inner surface 84 of the cased wellbore 22. Moving radially outwardly allows each radially outer surface 66 to engage the inner surface 84 to prevent the radially outer portions 86 and 88 from axially extruding between the radially outer surfaces 66 and the inner surface 84.

Referring now to FIG. 6, an oblique view of the backup ring assembly 30 is illustrated. The relatively rigid segments 56 and the relatively resilient segments 58 may together circumscribe the longitudinal axis.

The relatively rigid segments 56 may each include a pair of holes 90 and 92, such as a pair of through holes, extending axially from the second axially facing surface 82 toward the first axially facing surface 80. Each hole 90 and 92 may be cylindrical to receive a fastener 94 (shown in FIG. 7). In an embodiment, more than two holes are provided. In another embodiment, fewer than two holes are provided. For example, the relatively rigid support segments may be fixed to the corresponding relatively rigid segment with another suitable attachment device or method (e.g., welding or pinning), or the relatively rigid support segment may be fixed to another portion of the backup ring.

Figure 7:
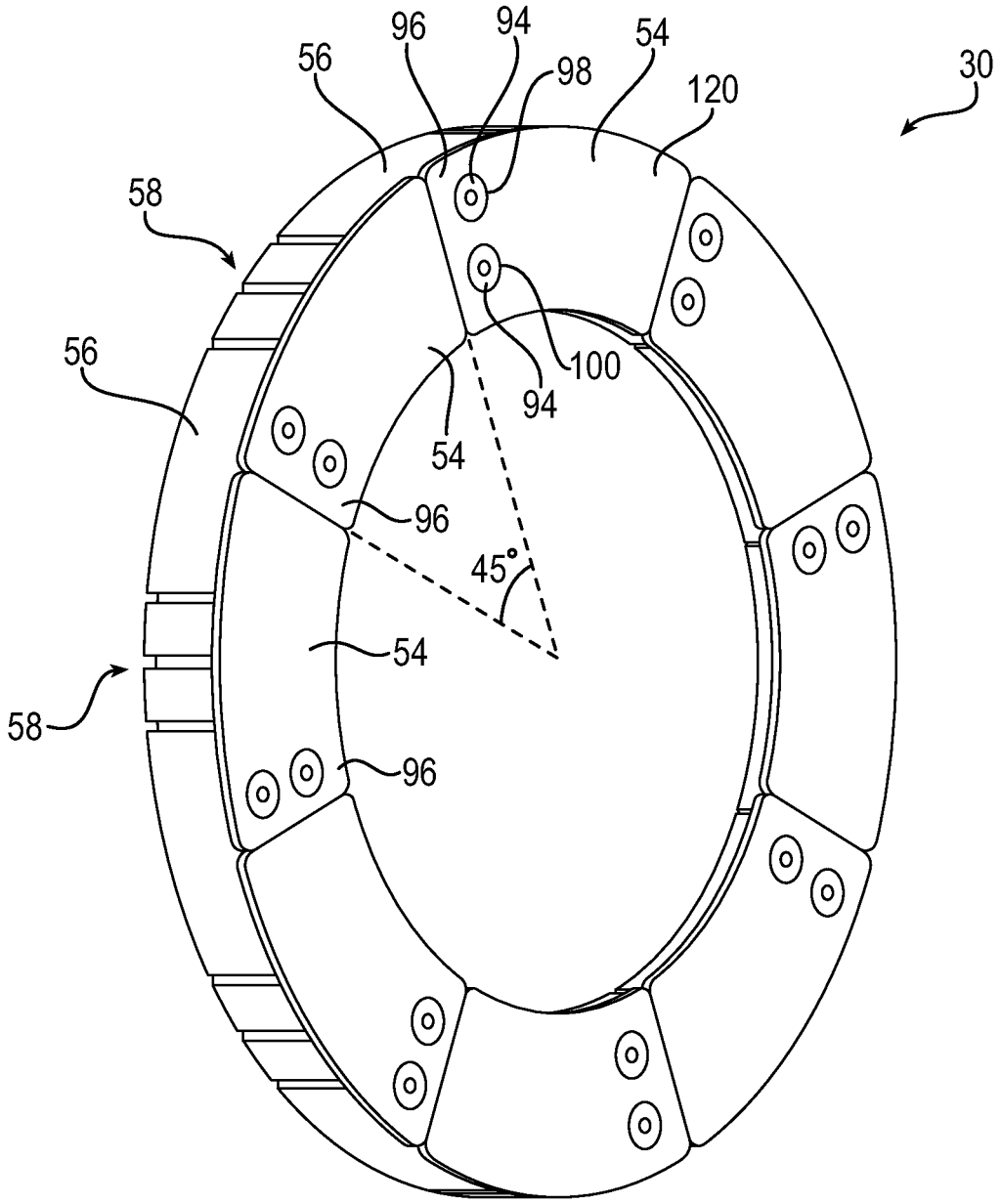
FIG. 7 is an oblique view of relatively rigid support segments of the backup ring assembly of FIG. 6.

Referring now to FIG. 7, the relatively rigid support segments 54 of the backup ring assembly 30 may be circumferentially arranged around the longitudinal axis. For example, the relatively rigid support segments 54 may together form an annulus when in the unexpanded state. Each relatively rigid support segment 54 may be axially aligned with a corresponding relatively resilient segment 58. Axially aligning each relatively rigid support segment 54 with each corresponding relatively resilient segment 58 allows the relatively rigid supports segment 54 to prevent the radially outer portions 86 and 88 of the sealing member 32 (shown in FIG. 5) from extruding axially through each relatively resilient segment 58.

One relatively rigid support segment 54 may be provided for each corresponding relatively rigid segment 56 and relatively resilient segment 58. For example, when eight relatively rigid segments 56 and eight relatively resilient segments 58 are provided, then eight relatively rigid support segments 54 may be provided. In an embodiment, less than one relatively rigid support segment is provided for each relatively resilient segment, and the relatively rigid support segment is axially aligned with and circumferentially spans more than one relatively resilient segment.

As discussed above, the relatively rigid support segments 54 may be fixed to a corresponding relatively rigid segment 56 to move radially with the corresponding relatively rigid segment 56. For example, each of the relatively rigid support segments 54 may have a circumferential end 96 that is radially and circumferentially fixed to the corresponding relatively rigid segment 56. Each relatively rigid support segment 54 may include a pair of through holes 98 and 100 that align with the holes 90 and 92 (shown in FIG. 6) in the corresponding relatively rigid segment 56. The holes 98 and 100 allow the fastener 94, which may be a rivet or a bolt, to fix each relatively rigid support segment 54 to the corresponding relatively rigid segment 56. When installed, the fastener 94 may be flush with the seal facing surface 120 of the relatively rigid support segment 54.

Each relatively rigid support segment 54 may form an annular sector that has an angular arc equal to 360° divided by the total number of relatively rigid support segments 54. For example, eight relatively rigid support segments 54 may together form the annulus and each relatively rigid support segment 54 may form annular sector that has a 45° opening angle. In an embodiment, the relatively rigid support segments may each have a different shape, such as a rectangular shape. In an embodiment, the relatively rigid support segments may together form a hollow-rectangle.

The relatively rigid support segments may have a yield strength anywhere from 10 kilopounds per square inch (ksi) to 200 ksi to prevent axial deformation when subject to high loads by the sealing member 32. For example, the relatively rigid support segments 54 may be made of American Society for Testing and Materials (ASTM) A-36 hot roll steel with a 36 ksi yield strength. The relatively rigid support segments may be made of any other suitable metal or composite, such as AISI 4130 sheet steel or any other material suitable for the relatively rigid segments 56.

Figure 8:
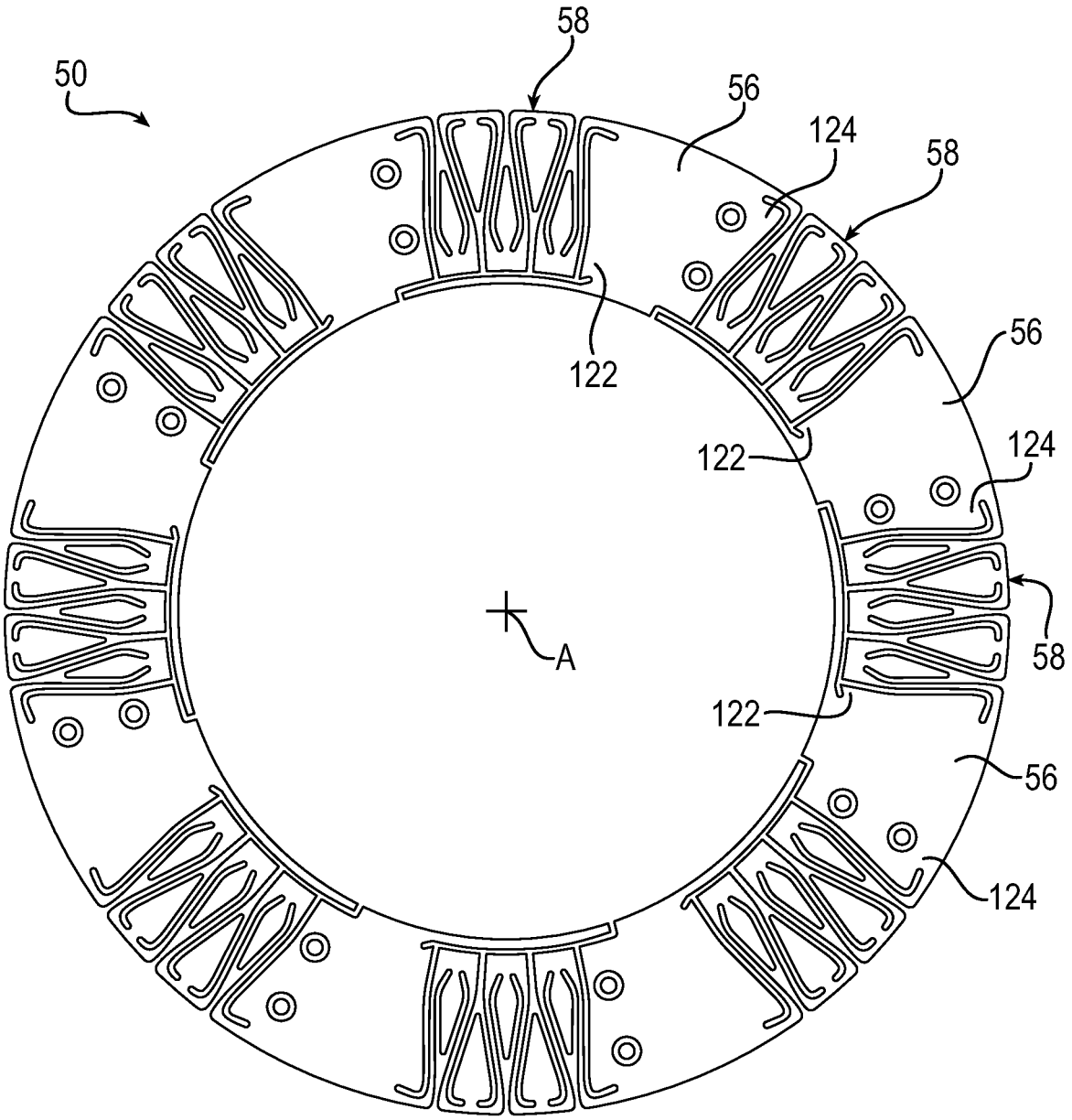
FIG. 8 is a bottom view of the backup ring of FIG. 6.
Figure 9:
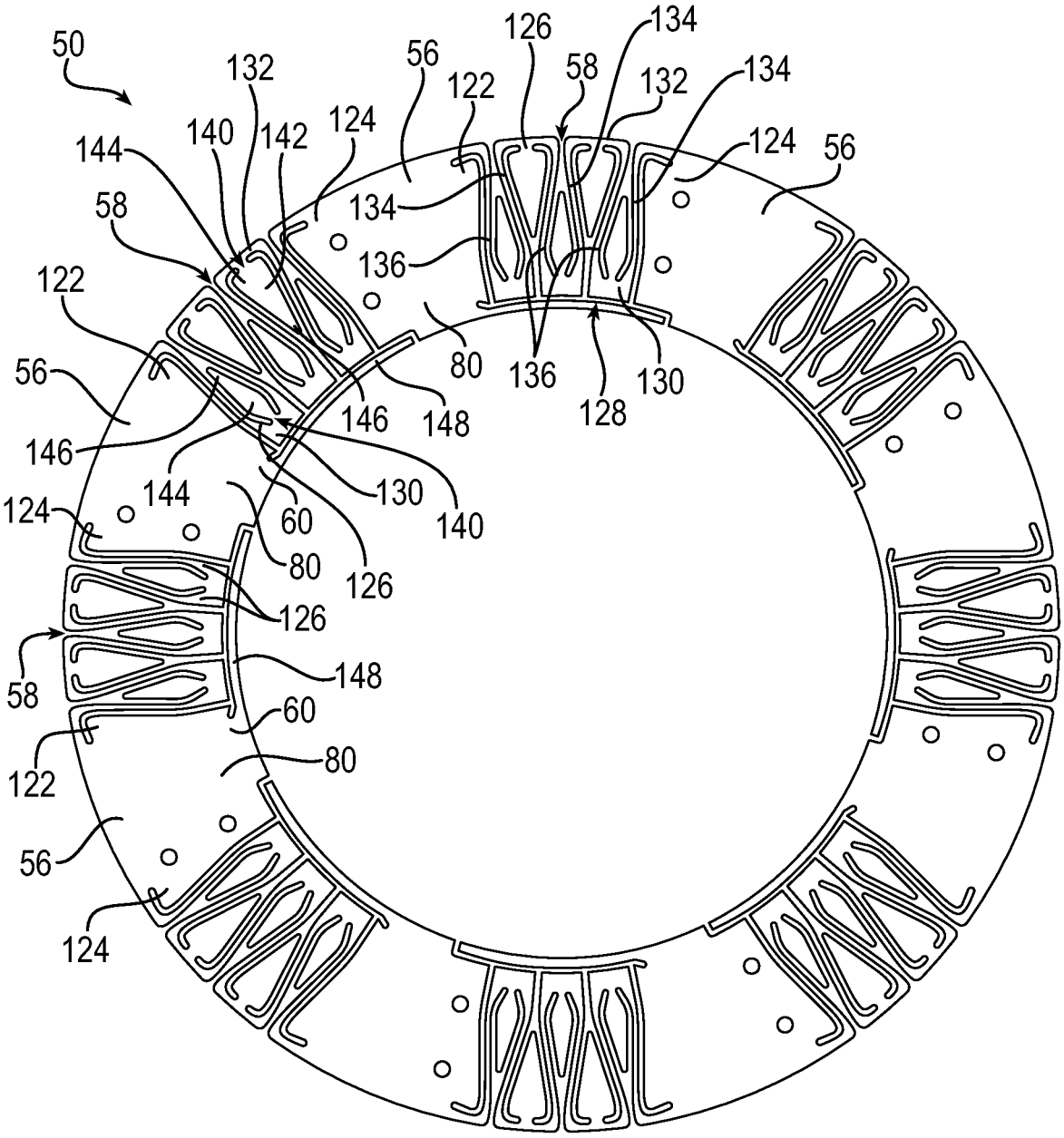
FIG. 9 is a top view of the backup ring of FIG. 8.

Referring now to FIGS. 8 and 9, the relatively rigid segments 56 may be one-piece with the plurality of relatively resilient segments 58. For example, the entire backup ring 50 may be made of the same continuous material, such as any of the above described materials.

Figure 10:
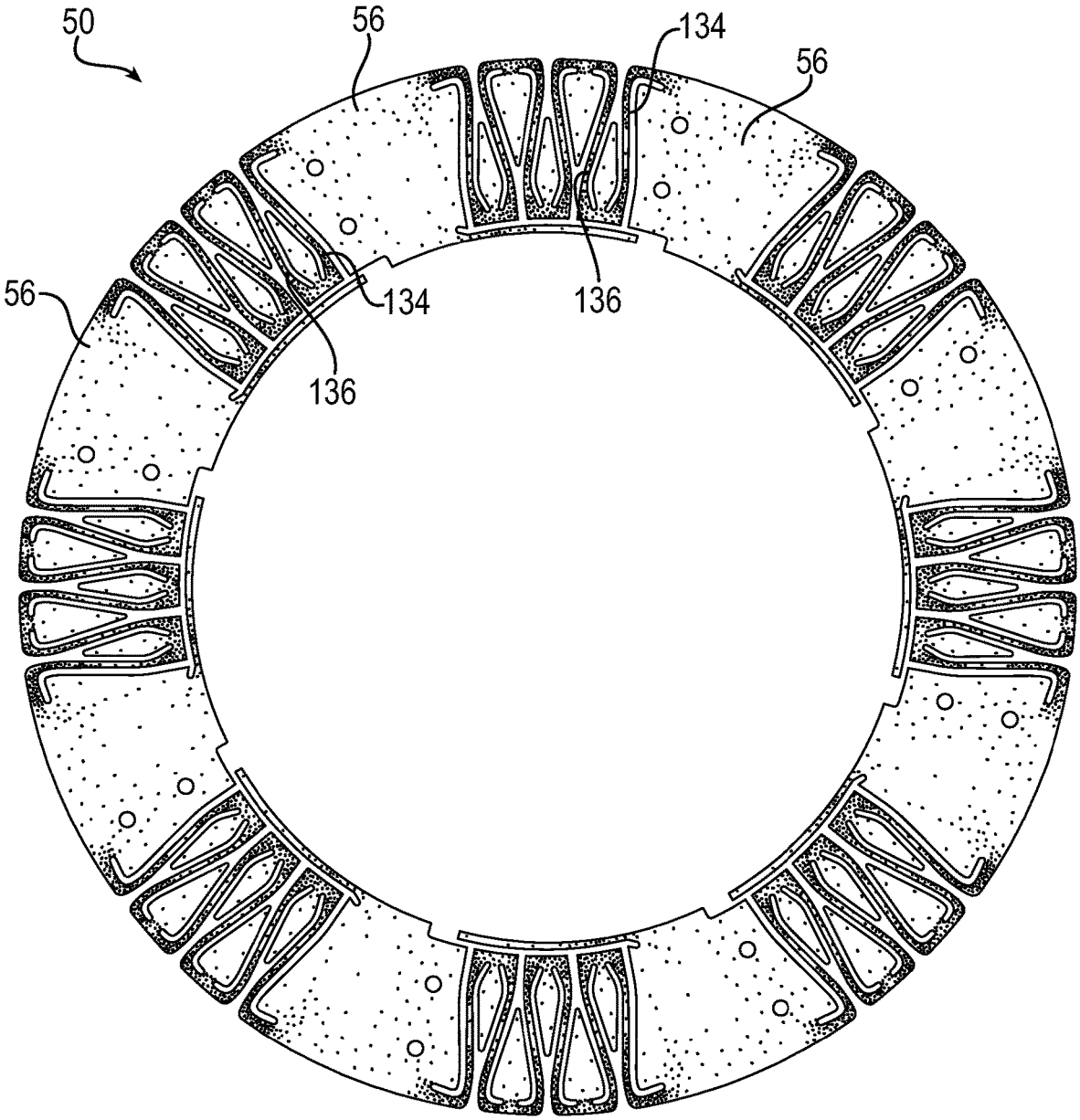
FIG. 10 is the top view of the backup ring of FIG. 9 including stippling to illustrate stress concentrations in the backup ring during use.

Each relatively rigid segment 56 may have a pair of circumferentially facing ends 122 and 124 that face in opposite circumferential directions. Each relatively resilient segment 58 may circumferentially extend between adjacent opposing circumferentially facing ends 124 and 122 to circumferentially urge together adjacent relatively rigid segments 56 when the relatively rigid segments 56 are moved radially outwardly to expand the backup ring 50. For example, each relatively resilient segment 58 may resiliently connect to the corresponding adjacent opposing circumferentially facing ends 124 and 122 such that each relatively resilient segment 58 resiliently expands circumferentially when the relatively rigid segments 56 are moved radially outwardly to expand the backup ring 50 (as shown in FIG. 10).

Referring now to FIG. 9, the relatively resilient segments 58 may include a first axially facing resilient surface 126 that extends in an inclined manner (shown best in FIG. 6) relative to the longitudinal axis to form a camming surface that may face radially inwardly toward the longitudinal axis. The incline of the first axially facing resilient surface 126 may match the incline of the first axially facing surface 80. For example, the entire first axially facing resilient surface 126 may be circumferentially aligned with the entire first axially facing surface 80.

The first axially facing resilient surface 126 may transform axial force from the inner mandrel 24 and/or the outer mandrel 26 (shown in FIG. 5) into a radial force. For example, each first axially facing resilient surface 126 may transform an axially inward force into a radially outward force to urge the corresponding relatively resilient segment 58 radially outward toward the inner surface 84 of the cased wellbore 22 (shown in FIG. 5).

The relatively resilient segments 58 may be made of any suitable metal or composite. For example, the relatively resilient segments 58 may be made of any material suitable for the relatively rigid segments 56.

Each relatively resilient segment 58 may circumferentially extend about the longitudinal axis with a cumulative circumferential length that is less than a circumferential length of the relatively rigid segments 56 when the relatively rigid segments 56 are not expanded radially outwardly. The circumferential length of the relatively resilient segments 58 and the relatively rigid segments 56 may be based on the amount of radial expansion required of the backup ring 50. The relatively resilient segments 58 may cumulatively extend more than 180° about the longitudinal axis A to allow radial expansion of up to 25% of the unexpanded diameter of the backup ring 50. For example, if the unexpanded backup ring 50 has a diameter of 12", the relatively resilient segments 58 may cumulatively extend 240° about the longitudinal axis A and the relatively rigid segments 56 may cumulatively extend 120° about the longitudinal axis A. The relatively resilient segments 58 may allow the backup ring to be expandable anywhere from 1% to 30% from the unexpanded state to the expanded state. In an embodiment, the backup ring is expandable anywhere from 1% to 10%.

Each relatively resilient segment 58 may include an undulating portion 128 that circumferentially extends between the corresponding pair of adjacent circumferentially facing ends 124 and 122. The undulating portion 128 may form radially outwardly opening loops 130 and radially inwardly opening loops 132 in a plane perpendicular to the longitudinal axis.

Each loop 130 and 132 may be formed by pair of cantilevered portions 134 and 136. Each cantilevered portion 134 and 136 may extend radially to resiliently connect to either an adjacent cantilevered portion 134 or 136 and the adjacent circumferentially facing end 122 or 124, or to resiliently connect to adjacent cantilevered portions 134 and 136. For example, the cantilevered portions 134 and 136 may form an accordion-like chain that resists circumferential compression when in a neutral state and that resists circumferential expansion when in a neutral or expanded state.

The cantilevered portions 134 and 136 may be resiliently connected to each adjacent circumferentially facing end 122 or 124 to circumferentially urge together adjacent relatively rigid segments 56 when in the expanded state. For example, each relatively resilient segment may include six cantilevered portions 134 and 136 and the circumferentially outermost cantilevered portions 134 and 136 may be fixed to a radially outer portion of each adjacent circumferentially facing end 122 or 124 of the corresponding relatively rigid segment 56. In an embodiment, each relatively resilient segment includes fewer than six cantilevered portions. In another embodiment, each resilient segment includes more than six cantilevered portions. In an alternative embodiment, only some of the relatively rigid segments are circumferentially urged toward each adjacent relatively rigid segment when the relatively rigid segments are moved radially outwardly.

Each relatively resilient segment 58 may include an axially extending portion 140 within each radially outwardly opening loop 130 and within each radially inwardly opening loop 132. Each axially extending portion 140 may include a first axially facing support surface 142 that has an axial thickness equal to an axial distance from the first axially facing surface 80 to the second axially facing surface 82.

The axially extending portion 140 may have a main portion 144 and an end portion 146 disposed within the interior of the corresponding loop 130 or 132. The main portion 144 may extend radially to the end portion 146. The main portion 144 may have a circumferential width that is greater than the end portion 146 to minimize gaps between the axially extending portion 144 and the corresponding loop 130 or 132. For example, the main portion 144 may have a circumferential length that is greater than the end portion 146, and may be spade-shaped. The greater circumferential length allows the main portion 144 to a gap that may be formed by circumferential widening adjacent a bight of the corresponding loop 130 or 132.

Each radial length of the axially extending portion 144 may be greater than 50% of a radial length of the relatively rigid segment 56. In an embodiment, some of or all of the axially extending portions have a radial length that is equal to or less than 50% of an adjacent radial length of the relatively rigid segment.

The axially extending portions 144 may extend radially from an interior of the corresponding loop 130 or 132. For example, the axially extending portions 144 may extend from the bight of the corresponding loop 130 or 132. In an embodiment, the axially extending portion may extend from another portion of the cantilevered portions.

The backup ring 50 may include circumferentially extending fingers 148 that are each disposed radially inward of a corresponding relatively resilient segment 58. Each circumferentially extending finger 148 may be radially aligned with the corresponding relatively resilient segment 58. Radially aligning the circumferentially extending fingers 148 with the relatively resilient segments 58 allows the circumferentially extending fingers 148 to prevent debris or an extruded portion of the sealing member 32 (shown in FIG. 5) from interfering with movement of the cantilevered portions 134 and 136.

The circumferentially extending fingers 148 may extend from the radially inner end 60 of the corresponding relatively rigid segment 56. For example, each circumferentially extending finger 148 may extend from the corresponding radially inner end 60 to a concavity in the adjacent radially inner end 60. Extending into the concavity allows the circumferentially extending fingers 148 to shield the relatively resilient members 58 when the backup ring 50 is in the expanded state (shown in FIG. 10). In an embodiment, the circumferentially extending fingers may extend from another portion of the backup ring.

The circumferentially extending fingers 148 may have an axial thickness equal to circumferentially aligned portions of the radially inner end 60 to form a portion of the camming surface of the relatively rigid segments 56. In an embodiment, the circumferentially extending fingers may have another suitable shape or size.

Referring now to FIG. 10, the backup ring 50 is illustrated in the expanded state and high concentrations of stress are indicated by a higher concentration of stippling. When the backup ring 50 is expanded the backup ring 50 may distribute stress primarily to radial ends of the cantilevered portions 134 and 136. While the cantilevered portions 134 and 136 are distributing stress the cantilevered portions 134 and 136 may circumferentially urge together adjacent relatively rigid segments 56. In an embodiment, the cantilevered portions may have a cross-section that is optimized to distribute stress evenly along each cantilevered portion.

Figure 11:
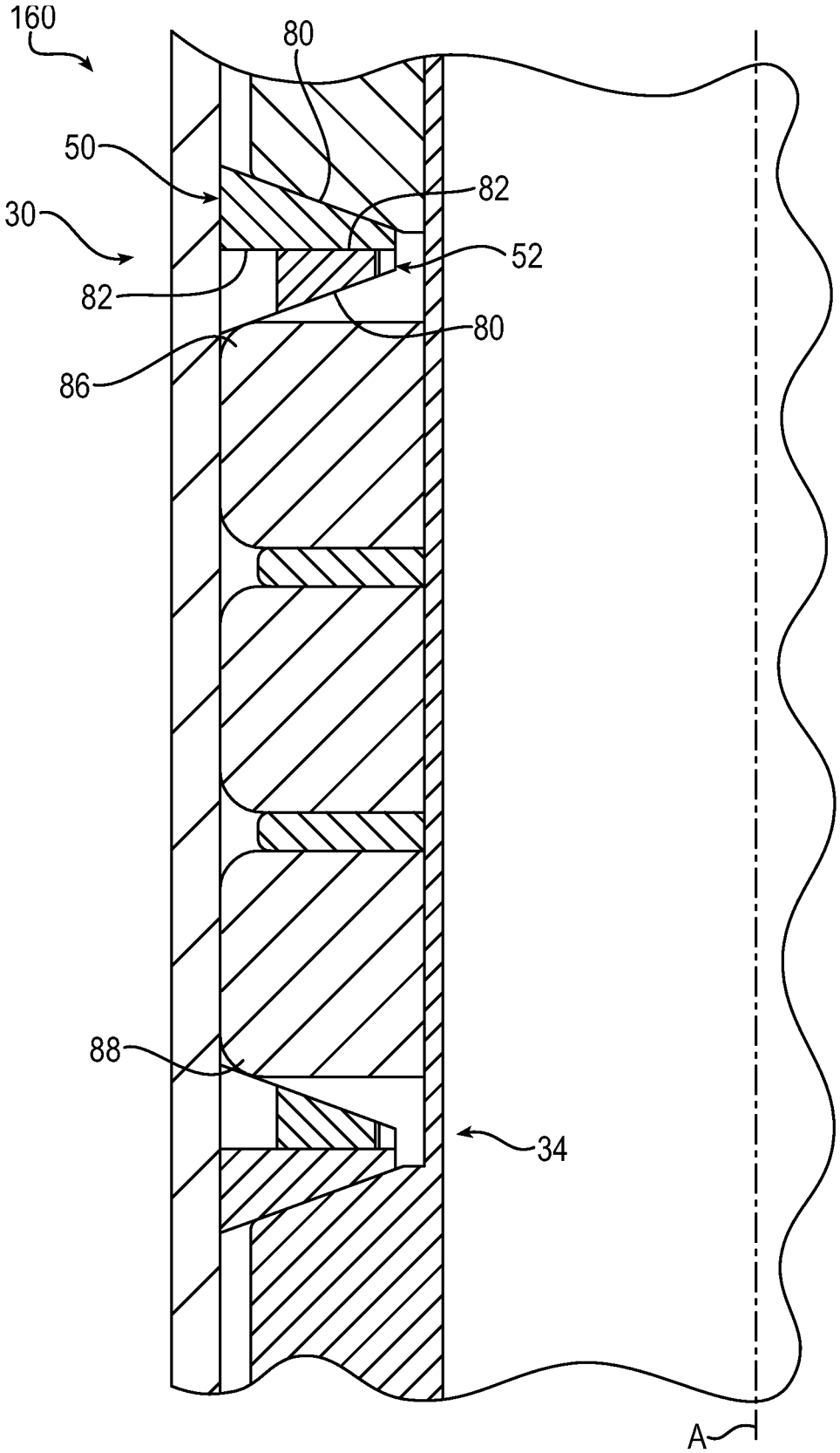
FIG. 11 is a partial side cross-sectional view of the cased wellbore and another exemplary tool assembly in an expanded state.

Turning now to FIG. 11, an exemplary embodiment of the tool assembly is shown at 160. The tool assembly 160 is substantially the same as the above-referenced tool assembly 20, and consequently the same reference numerals are used to denote structures corresponding to similar structures in the tool assemblies. In addition, the foregoing description of the tool assembly 20 is equally applicable to the tool assembly 160 except as noted below. Moreover, it will be appreciated that aspects of the tool assemblies may be substituted for one another or used in conjunction with one another where applicable.

The tool assembly 160 may include a first backup ring assembly 30 and a second backup ring assembly 34. Each backup ring assembly may include a first backup ring 50 and a second back up ring 52 that is reversely oriented to face axially opposite the first backup ring 50. For example, the first axially facing surfaces 80 of each backup ring 50 and 52 may face axially away from one another and the second axially facing surfaces 82 may abut one another.

Figure 12:
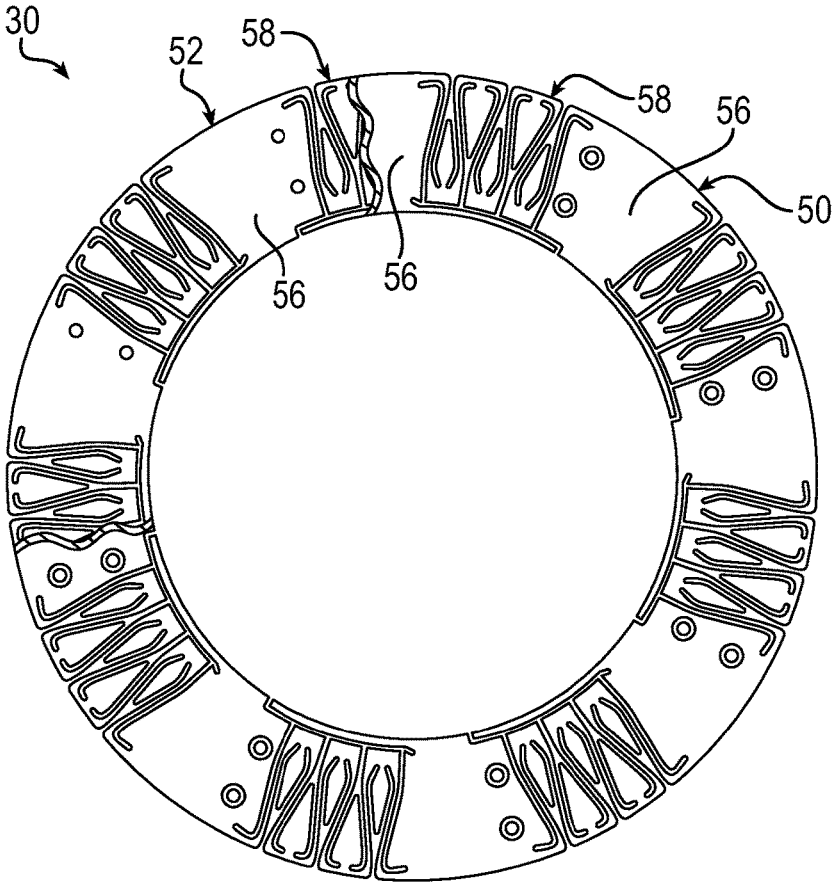
FIG. 12 is a top view of another exemplary backup ring assembly of the tool assembly of FIG. 11, with part of the backup ring assembly removed to show overlapping backup rings.

Referring now to FIG. 12, the second backup ring 52 may include a plurality of relatively resilient segments 58 and a plurality of relatively rigid segments 56 that form a plurality of relatively resilient support segments and a plurality of relatively rigid support segments, respectively. The second backup ring 52 may be rotated about the longitudinal axis relative to the first backup ring 50 such that the relatively rigid segments 56 of the second backup ring 52 may be axially aligned with the relatively resilient support segments 56 of the first backup ring 50. Axially aligning the plurality of relatively rigid segments 56 with the corresponding relatively resilient support segments 58 of the other backup ring 50 or 52 allows the backup rings 50 and 52 to prevent extrusion of a radially outer portion 86 and 88 of a sealing member 32 (shown in FIG. 11).

Figure 13:
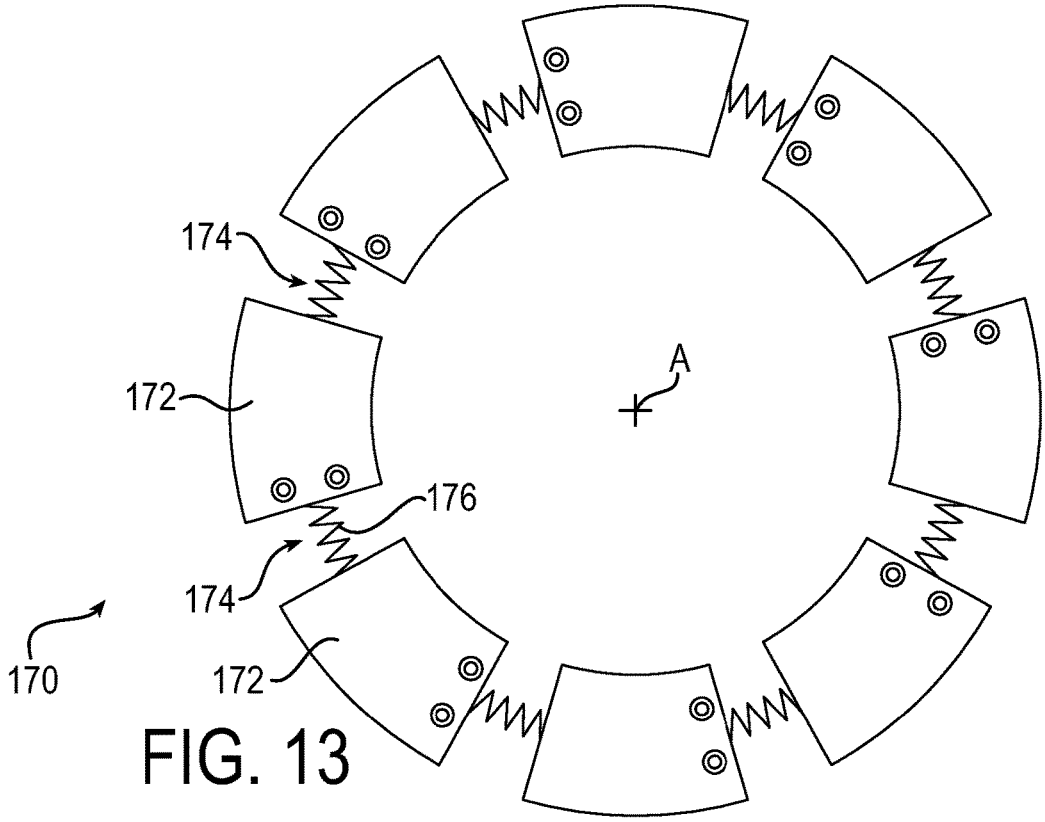
FIG. 13 is a top view of another exemplary backup ring.

Turning now to FIG. 13, an exemplary embodiment of the backup ring is shown at 170. The backup ring 170 is substantially the same as the above-referenced backup rings 50 and 52. In addition, the foregoing description of the backup rings 50 and 52 is equally applicable to the backup ring 170 except as noted below. Moreover, it will be appreciated that aspects of the backup rings may be substituted for one another or used in conjunction with one another where applicable.

The backup ring 170 may include a plurality of relatively rigid segments 172 and a plurality of relatively resilient segments 174. The relatively rigid segments 172 and the relatively resilient segments 174 may be circumferentially arranged around a longitudinal axis A and each relatively resilient segment 174 may be alternately disposed with respect to each relatively rigid segment 172.

Each relatively resilient segment 174 may include a spring 176 that extends circumferentially between the corresponding pair of adjacent relatively rigid segments 172 to resiliently expand circumferentially when the relatively rigid segments 172 are moved radially outwardly to expand the backup ring 170. When the backup ring 170 is expanded, the springs 176 may urge together adjacent relatively rigid segments 172.

Figure 14:
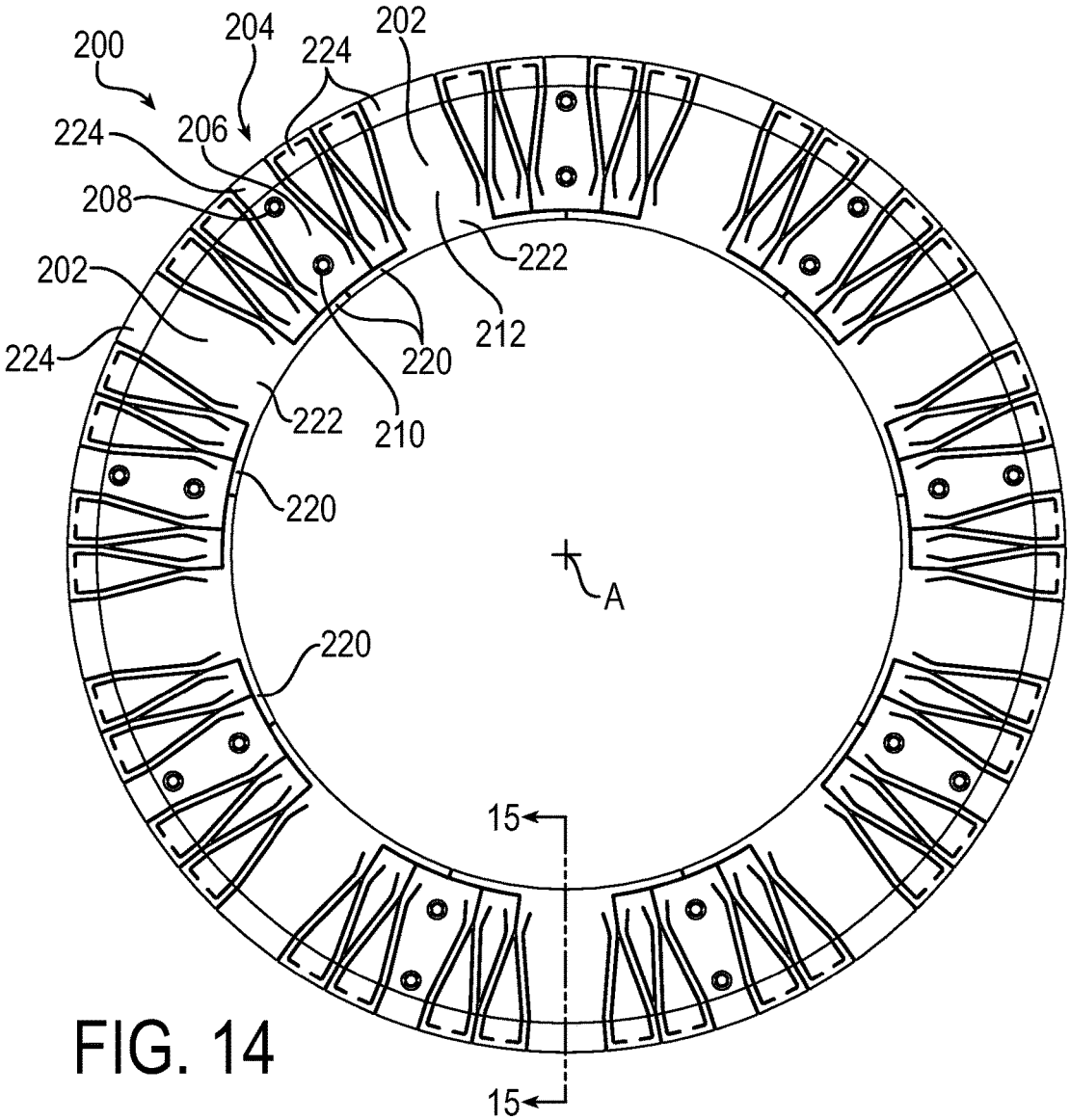
FIG. 14 is a top view of another exemplary backup ring.
Figure 15:
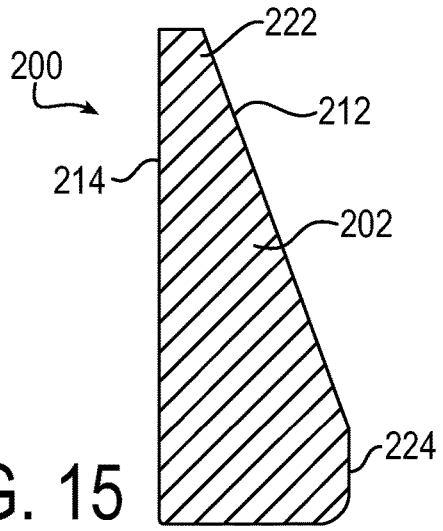
FIG. 15 is a partial side cross-sectional view of the backup ring of FIG. 14 taken along line 15-15.

Turning now to FIGS. 14 and 15, an exemplary embodiment of the backup ring is shown at 200. The backup ring 200 is substantially the same as the above-referenced backup rings 50, 52, and 170. In addition, the foregoing description of the backup rings 50, 52, and 170 is equally applicable to the backup ring 200 except as noted below. Moreover, it will be appreciated that aspects of the backup rings may be substituted for one another or used in conjunction with one another where applicable.

The backup ring 200 may include a plurality of relatively rigid segments 202 and a plurality of relatively resilient segments 204 (shown only in FIG. 14). The relatively rigid segments 202 and the relatively resilient segments 204 may be circumferentially arranged around a longitudinal axis A and each relatively resilient segment 204 may be alternately disposed with respect to each relatively rigid segment 202.

Each relatively resilient segment 204 may include an axially extending portion 206 with a pair of holes 208 and 210, such as a pair of through holes, extending axially from an axially facing surface that faces a relatively rigid support segment (shown in FIG. 7) to an axially facing surface that faces away from the relatively rigid support segment. The surface facing the relatively rigid support segment (shown in FIG. 7) may be coplanar with a first axially facing surface 212 and the surface facing away from the relatively rigid support segment may be coplanar along a frusto-conical plane with a second axially facing surface 214 (shown only in FIG. 15).

In an embodiment, each of the relatively rigid support segments (shown in FIG. 7) have a circumferential central portion that is radially and circumferentially fixed to the corresponding relatively resilient segment. For example, each relatively rigid support segment may include a pair of through holes that align with the holes of the corresponding axially extending portion (shown in FIG. 14) so that circumferentially extending ends of the relatively resilient support segment may be radially aligned with each circumferential end of the corresponding relatively resilient segment.

The axially extending portion 206 may have a radial length that is greater than 80% a radial length of the relatively rigid segment 202. For example, a radially outer end of the axially extending portion 206 may form a radially outer extent of the backup ring 200 when unexpanded. The radially outer end may have a circumferential thickness that is equal to or substantially equal to a radially inner end of the axially extending portion 206. The circumferential thickness of the radially outer end may be larger than a diameter of the holes 208 and 210.

Each hole 208 and 210 may be cylindrical to receive the fastener 94 (shown in FIG. 7). In an embodiment, more than two holes are provided. In another embodiment, fewer than two holes are provided. For example, relatively rigid support segments may be fixed to the corresponding relatively resilient segment with another suitable attachment device or method (e.g., welding or pinning).

The backup ring 200 may include circumferentially extending fingers 220 that are each disposed radially inward of a corresponding relatively resilient segment 204. Each relatively rigid segment 202 may include a pair of circumferentially extending fingers 220 (not shown in FIG. 15) that extend in circumferentially opposite directions to each radially align with a different adjacent relatively resilient segment 204.

The circumferentially extending fingers 220 may extend from a radially inner end 222 of the corresponding relatively rigid segment 202. For example, each circumferentially extending finger 220 may extend from the corresponding radially inner end 222 to a circumferential end of the adjacent circumferentially extending finger 220. Each adjacent end of the adjacent circumferentially extending fingers 220 may be radially aligned with a radially inner end of the adjacent axially extending portion 206 to prevent debris from interfering with the corresponding relatively resilient segment 204.

The backup ring 200 may include a stacking surface 224 at a radially outer end of each relatively rigid segment 202 and/or each relatively resilient segment 204. The stacking surface 224 may circumscribe the longitudinal axis A and extend perpendicular to the longitudinal axis A. For example, the stacking surface 224 may be planar and face away from the second axially facing surface 214 (shown only in FIG. 15). In an embodiment, the stacking surface does not circumscribe the longitudinal axis. For example, the stacking surface may only be formed on some of the relatively rigid segments 202 and/or some of the relatively resilient segments 204.

The stacking surface 224 may allow the backup ring 200 to be more easily longitudinally stacked with other adjacent backup rings. Stacking the backup rings may allow each backup ring to be identically machined (e.g., by wire electrical discharge machining) to form the relatively rigid segments 202 and/or the relatively resilient segments 204 of the backup ring 200.

Figure 16:
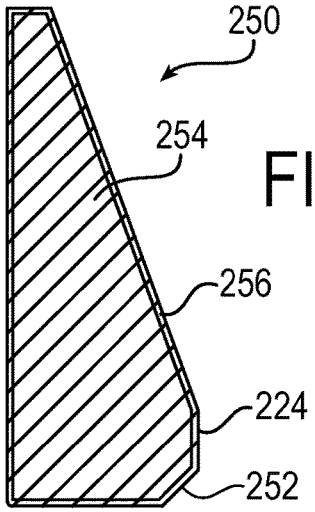
FIG. 16 is a partial side cross-sectional view of an exemplary backup ring that includes a chamfered radially outer end.

Turning to FIG. 16, an exemplary embodiment of the backup ring is shown at 250. The backup ring 250 is substantially the same as the above-referenced backup rings 50, 52, 170, and 200. In addition, the foregoing description of the backup rings 50, 52, 170, and 200 is equally applicable to the backup ring 250 except as noted below. Moreover, it will be appreciated that aspects of the backup rings may be substituted for one another or used in conjunction with one another where applicable.

The backup ring 250 may include a chamfer 252 at a radially outer end of each relatively rigid segment 254 and/or each relatively resilient segment (e.g., the resilient segments 204 illustrated in FIG. 14). The chamfer 252 may circumscribe the longitudinal axis A. For example, the chamfer extends in an inclined manner relative to the longitudinal axis A from a stacking surface 224.

The chamfer 252 may reduce the risk of the backup ring 250 catching on a restriction. For example, when the backup ring 250 is removed from a wellbore (e.g., the cased wellbore 22 shown in FIG. 1) and the backup ring 250 is not fully retracted, the chamfer 252 reduces the likelihood that the backup ring 250 will get caught on a restriction in the wellbore as compared to an embodiment without the chamfer 252.

The backup ring 250 may include a surface treated layer 256 to reduce friction and/or to protect against corrosion. The surface treated layer 256 may form the entire outer surface of the backup ring 250 such that only the surface treated layer 256 would be exposed to wellbore fluids (e.g., brines or muds) or other corrosive elements.

The surface treated layer 256 may be formed by a surface treatment such as quench polish quench (QPQ), or other corrosion and/or friction reducing treatments. In an embodiment, the surface treated layer is sprayed on or is formed by a submersion process.

Figure 17:
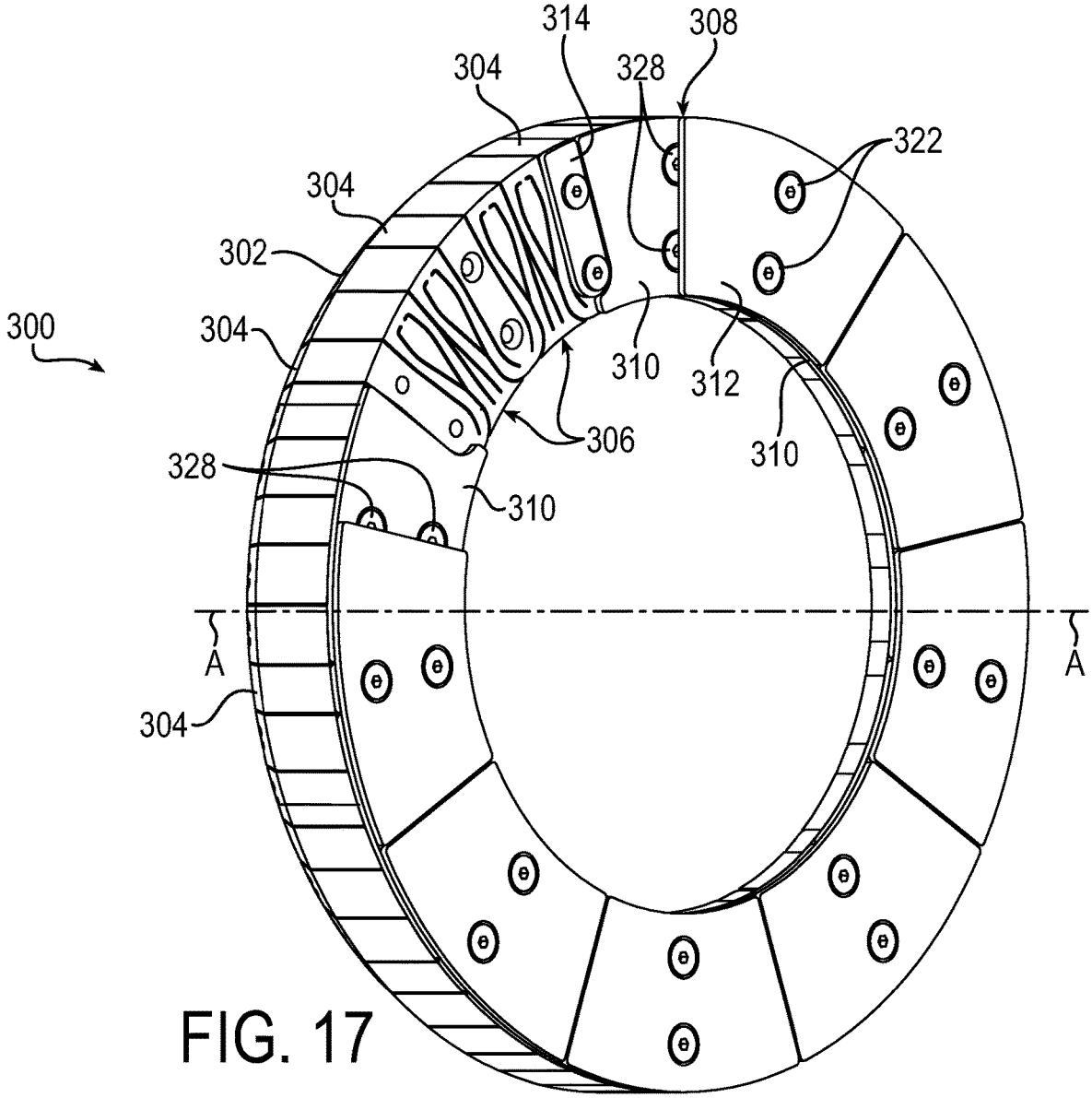
FIG. 17 is an oblique view of another exemplary backup ring assembly with an exemplary backup ring and an exemplary dual layer support segment assembly, where a part of the dual layer support segment assembly is removed to show overlapping relatively rigid support segments and the backup ring.

Turning to FIG. 17, an exemplary embodiment of the backup ring assembly is shown at 300 and an exemplary embodiment of the backup ring is shown at 302. The backup ring 302 is substantially the same as the above-referenced backup rings 50, 52, 170, 200, and 250. In addition, the foregoing description of the backup rings 50, 52, 170, 200, and 250 is equally applicable to the backup ring 302 except as noted below. Moreover, it will be appreciated that aspects of the backup rings may be substituted for one another or used in conjunction with one another where applicable.

The backup ring 302 may include relatively rigid segments 304 and relatively resilient segments 306 that are circumferentially arranged around the longitudinal axis A. The relatively resilient segments 306 resiliently connect corresponding adjacent relatively rigid segments 304 to one another.

The backup ring assembly 300 may include a dual layer support segment assembly 308. The dual layer support segment assembly 308 may include relatively rigid inner support segments 310 and relatively rigid outer support segments 312 that are circumferentially arranged around the longitudinal axis A. Each circumferential end of each relatively rigid inner support segment 310 may be axially aligned with a central portion of the corresponding relatively rigid outer support segment 312.

A central portion of each relatively rigid inner support segment 310 may be fixed to the corresponding relatively rigid segment 304, and the central portion of each corresponding relatively rigid outer support segment 312 may be fixed to the corresponding relatively rigid segment 304. Fixing the central portions allows the circumferential ends of each relatively rigid inner support segment 310 and each relatively rigid outer support segment 312 to be circumferentially offset from one another when the backup ring 302 is expanded or unexpanded. The circumferential offset of the circumferential ends may reduce or eliminate exposure of the relatively resilient segments 306 of the backup ring 302 to direct axial force (e.g., from a sealing member 32 shown in FIG. 5 that is axially extruding) compared to a single layer support segment assembly.

The backup ring assembly 300 may include an axial spacer 314 that has an axial thickness equal to an axial thickness of each adjacent relatively rigid inner support segments 310. The axial spacer 314 may provide axial support for each corresponding relatively rigid outer support segment 312.

Figure 18:
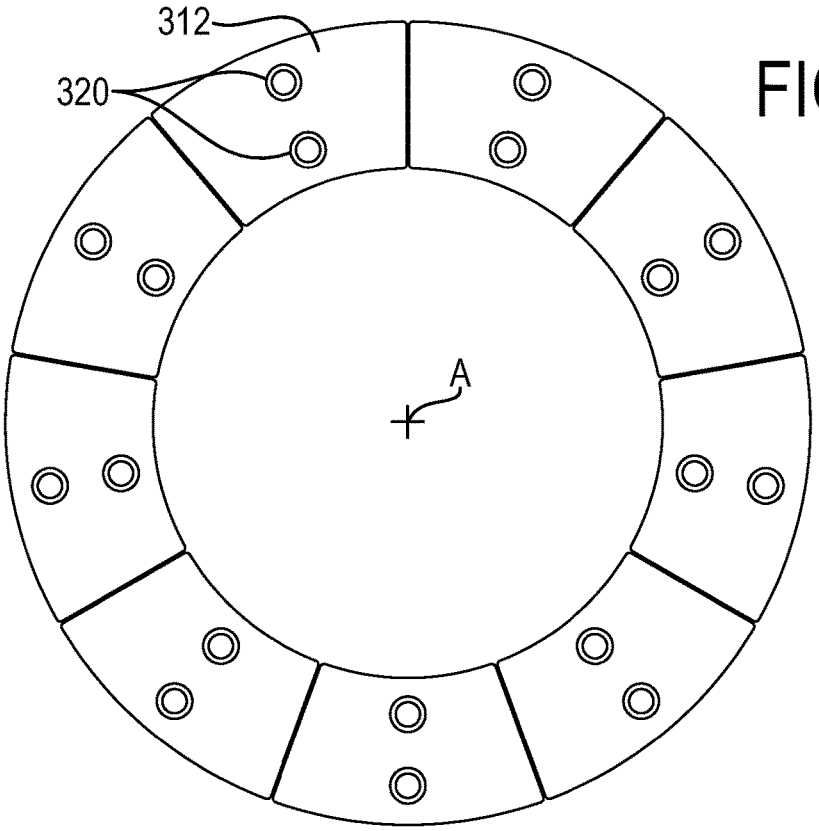
FIG. 18 is a top view of relatively rigid outer support segments of the dual layer support segment assembly of FIG. 17, where the relatively rigid outer support segments are circumferentially arranged around the longitudinal axis A.
Figure 19:
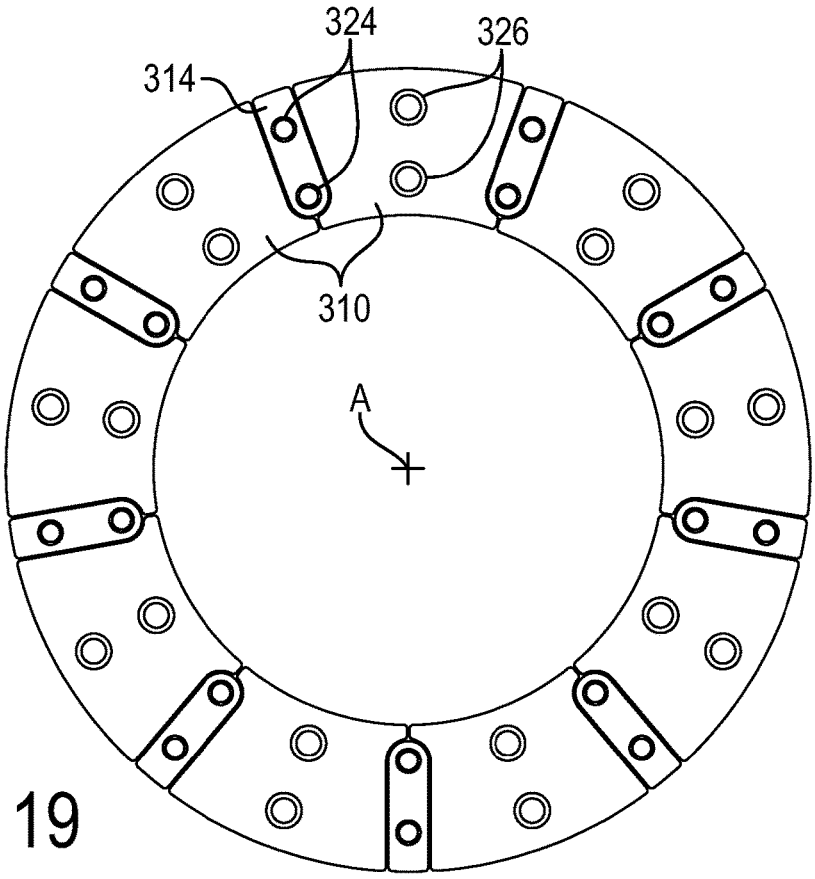
FIG. 19 is a top view of relatively rigid inner support segments of the dual layer support segment assembly of FIG. 17, where the relatively rigid inner support segments are circumferentially arranged around a longitudinal axis A.

Referring now to FIG. 18 and to FIG. 19, the central portion of each relatively rigid outer support segment 312 includes holes 320 to allow a shaft of a bolt (e.g., an axially outer bolt 322 shown in FIG. 17) through. Referring now to FIG. 19, each axial spacer 314 may include holes 324 to allow the shaft of the bolt through.

The central portion of each relatively rigid inner support segment 310 includes holes 326 to allow the shaft of a bolt (e.g., an axially inner bolt 328 shown in FIG. 17) through. The circumferential ends of each relatively rigid outer support segment 312 and of each relatively rigid inner support segment 310 may be a free end.

Referring again to FIG. 17, the axially outer bolts 322 may fix each corresponding relatively rigid segment 304 to both the central portion of the corresponding relatively rigid outer support segment 312 and to the corresponding axial spacer 314. The axially inner bolts 328 may fix each corresponding relatively rigid segment 304 to the central portion of the corresponding relatively rigid inner support segment 310.

As the backup ring assembly 300 expands, each relatively rigid inner support segment 310 moves radially outwardly with the corresponding relatively rigid segment 304. Each relatively rigid outer support segment 312 and the corresponding axial spacer 314 moves radially outwardly with the corresponding relatively rigid segment 304. The relatively rigid inner support segments 310 move in a corresponding radial direction that is circumferentially offset from a radial direction of movement of each adjacent relatively rigid outer support segment 312.

During the expansion, the relatively resilient segments 306 may remain axially aligned with one or both of the corresponding relatively rigid inner support segment 310 and the corresponding relatively rigid outer support segment 312. Each circumferential end of the corresponding relatively rigid inner support segment 310 becomes circumferentially spaced from the adjacent relatively rigid inner support segment 310. Each circumferential end of the corresponding relatively rigid outer support segment 312 becomes circumferentially spaced from the adjacent relatively rigid outer support segment 312. The circumferential spacings are each axially aligned with the corresponding relatively rigid outer support segment 312 or the corresponding relatively rigid inner support segment 310.

When the backup ring assembly 300 is expanded, the relatively resilient segments 306 may circumferentially urge together adjacent relatively rigid segments 304. The circumferential urging allows the backup ring assembly 300 to radially constrict (e.g., back to its unexpanded state).

Figure 20:
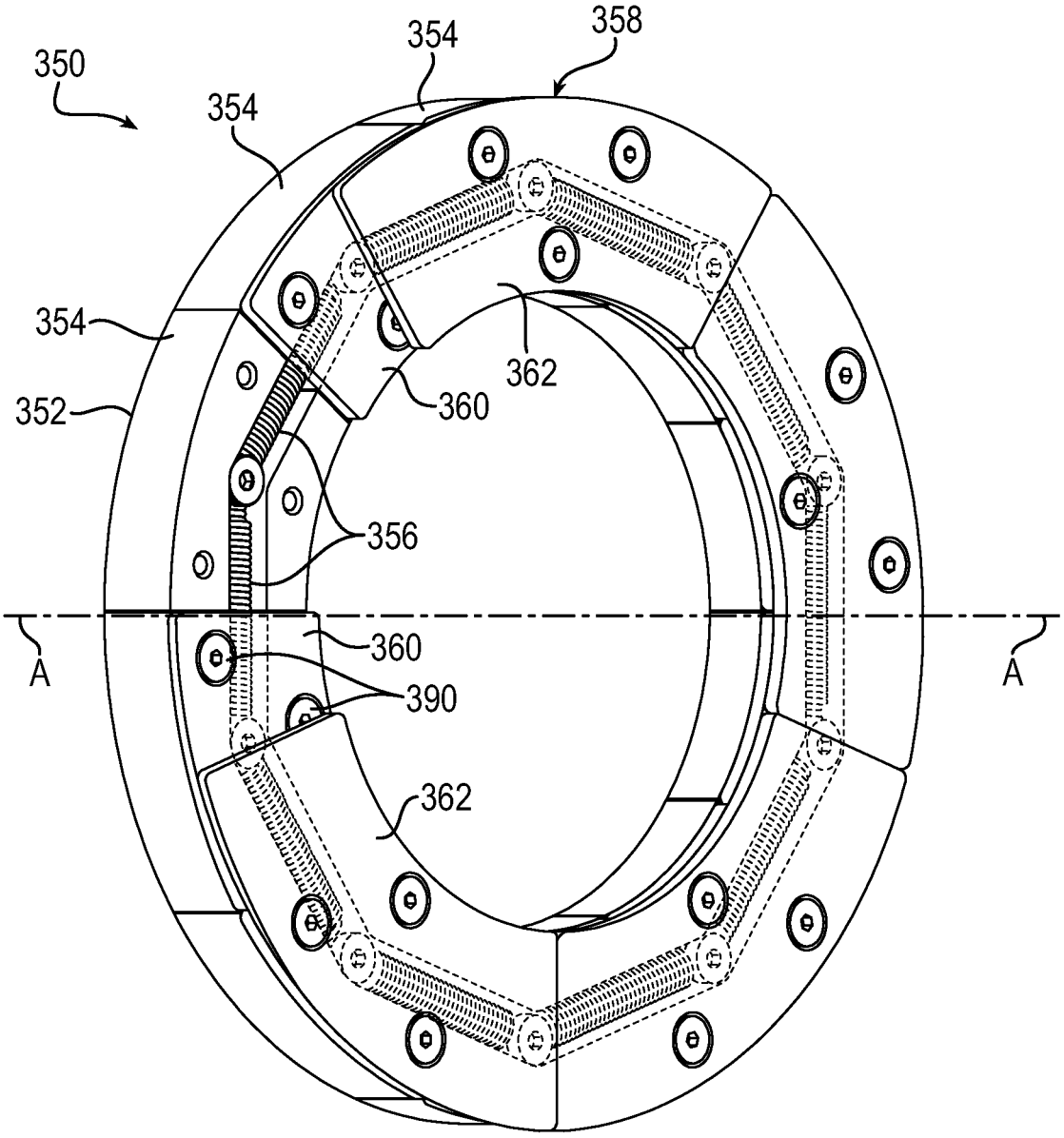
FIG. 20 is an oblique view of another exemplary backup ring assembly with an exemplary backup ring and an exemplary dual layer support segment assembly, where a part of the dual layer support segment assembly is removed to show an exemplary relatively resilient segment of the backup ring.

Turning to FIG. 20, an exemplary embodiment of the backup ring assembly is shown at 350 and an exemplary embodiment of the backup ring is shown at 352. The backup ring assembly 350 may include a dual layer support segment assembly 358.

The backup ring 352 is substantially the same as the above-referenced backup rings 50, 52, 170, 200, 250, and 302. In addition, the foregoing description of the backup rings 50, 52, 170, 200, 250, and 302 is equally applicable to the backup ring 352 except as noted below. Moreover, it will be appreciated that aspects of the backup rings may be substituted for one another or used in conjunction with one another where applicable.

The backup ring 352 may include relatively rigid segments 354 and relatively resilient segments 356 that are circumferentially arranged around a longitudinal axis A. Each relatively resilient segment 356 may be a spring that resiliently connects corresponding adjacent relatively rigid segments 354 to one another. Portions of the springs that are behind the dual layer support segment assembly 358 are illustrated in dashed lines.

The dual layer support segment assembly 358 may include relatively rigid inner support segments 360 and relatively rigid outer support segments 362 that are circumferentially arranged around the longitudinal axis A. Each circumferential end of each relatively rigid inner support segment 360 may be axially aligned with a central portion of the corresponding relatively rigid outer support segment 362. Each relatively rigid inner support segment 360 may be fixed to the corresponding relatively rigid segment 354 to maintain the axial alignment, as discussed further below with reference to FIG. 23.

Figure 21:
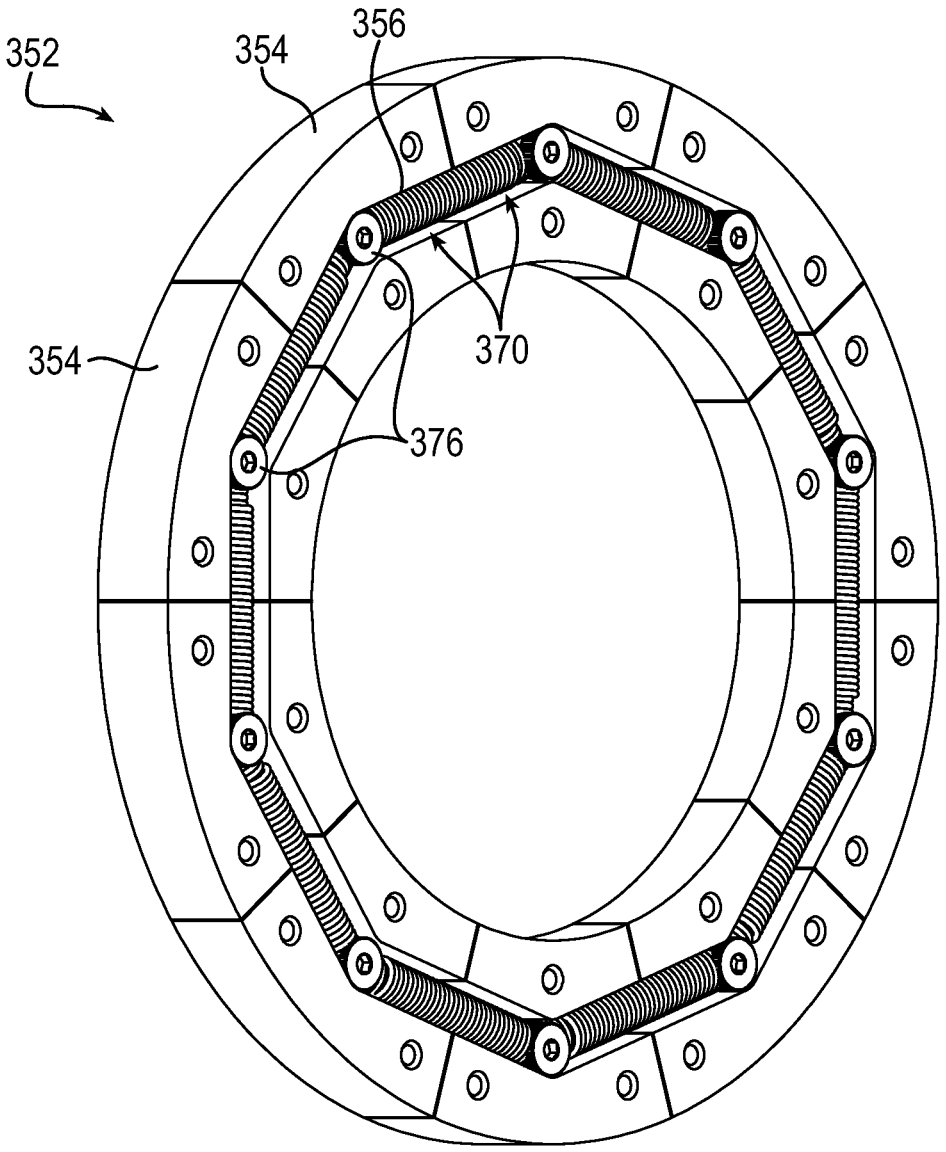
FIG. 21 is an oblique view of the backup ring of FIG. 20.

Referring now to FIG. 21, each relatively rigid segment 354 may include a cavity 370 that the corresponding relatively resilient segment 356 is disposed within. Each cavity 370 may extend circumferentially from one circumferential end of the corresponding relatively rigid segment 354 to the other circumferential end. Each cavity 370 may be as axially deep or axially deeper than the axial thickness of the corresponding relatively resilient segment 356 to prevent the resilient segments 356 from protruding axially beyond the relatively rigid segments 354.

Figure 22:
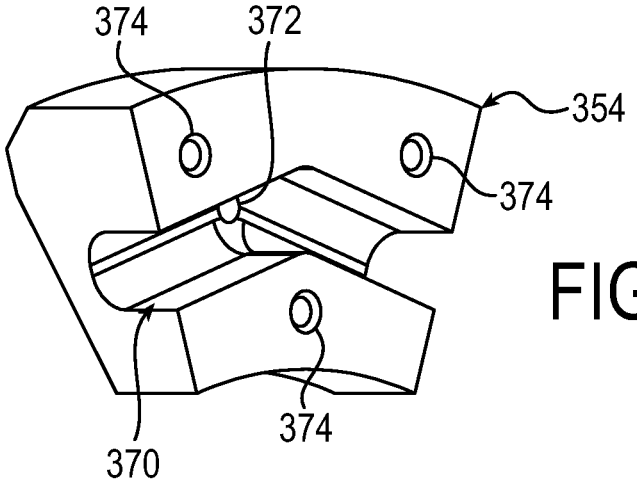
FIG. 22 is an oblique view of an exemplary relatively rigid segment of the backup ring FIG. 21.

Referring briefly to FIG. 22 and then back to FIG. 21, each cavity 370 may have a U-shaped cross-section that extends in a V-shape from one circumferential end of the corresponding relatively rigid segment 354 to the other circumferential end. Each relatively rigid segment 354 may include a cavity bolt hole 372 that extends from a central portion of the cavity 370, and may include bolt holes 374 that are radially offset from the cavity 370.

Referring again briefly to FIG. 21, the backup ring 352 may include bolts 376 that each attach to the corresponding relatively rigid segment 354 (e.g., via the corresponding cavity bolt hole 372 shown in FIG. 22). Each bolt 376 is connected to corresponding adjacent ends of adjacent relatively resilient segments 356 to resiliently connect the corresponding adjacent relatively rigid segments 354.

Figure 23:
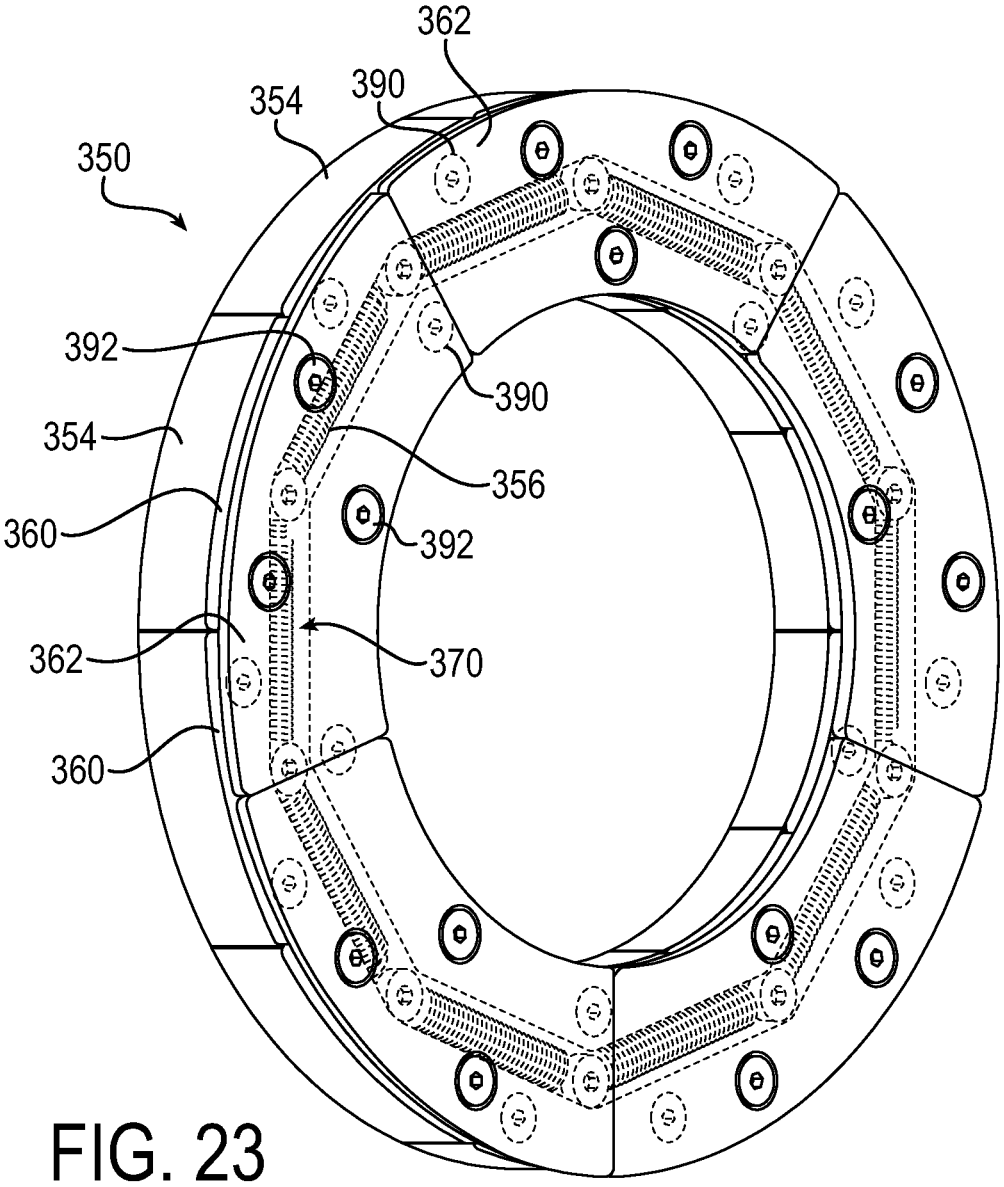
FIG. 23 is an oblique view of the entire backup ring assembly of FIG. 20, where the relatively resilient member is hidden and shown in dashed lines.

Turning now to FIG. 23, each relatively rigid inner support segment 360 encloses the corresponding cavity 370 (shown in dashed lines). Enclosing the cavities 370 allows the corresponding relatively rigid inner support segment 360 to prevent the corresponding relatively resilient segment 356 (shown in dashed lines) from moving axially out of the corresponding cavity 370.

Axially inner bolts 390 (shown in dashed lines) or axially outer bolts 392 may fix each relatively rigid inner support segment 360 to the corresponding relatively rigid segment 354. The axially inner bolts 390 may fix the corresponding relatively rigid inner support segment 360 to the corresponding relatively rigid segment 354. The axially outer bolts 392 may fix the corresponding relatively rigid outer support segment 362 and the corresponding relatively rigid inner support segment 360 to the corresponding relatively rigid segment 354.

As the backup ring assembly 350 expands, the relatively resilient segments 356 stretch circumferentially between corresponding adjacent relatively rigid segments 354, and the adjacent relatively rigid segments 354 become circumferentially spaced from one another. Each relatively rigid inner support segment 360 becomes circumferentially spaced from each adjacent relatively rigid inner support segment 360, and the circumferential spacing is axially aligned with the corresponding relatively rigid outer support segment 362. Each relatively rigid outer support segment 362 becomes circumferentially spaced from each adjacent outer support segment 362, and the circumferential spacing is axially aligned with the corresponding relatively rigid inner support segment 360.

When the backup ring assembly 350 is expanded, the relatively resilient segments 356 may circumferentially urge together adjacent relatively rigid segments 354. The circumferential urging allows the backup ring assembly 350 to radially constrict (e.g., back to its unexpanded state).

Although the invention has been shown and described with respect to a certain embodiment or embodiments, it is obvious that equivalent alterations and modifications will occur to others skilled in the art upon the reading and understanding of this specification and the annexed drawings. In particular regard to the various functions performed by the above described elements (components, assemblies, devices, compositions, etc.), the terms (including a reference to a "means") used to describe such elements are intended to correspond, unless otherwise indicated, to any element which performs the specified function of the described element (i.e., that is functionally equivalent), even though not structurally equivalent to the disclosed structure which performs the function in the herein illustrated exemplary embodiment or embodiments of the invention. In addition, while a particular feature of the invention may have been described above with respect to only one or more of several illustrated embodiments, such feature may be combined with one or more other features of the other embodiments, as may be desired and advantageous for any given or particular application.

What is claimed is:

1. A backup ring assembly, including:

a backup ring, comprising:

a plurality of rigid segments that are circumferentially arranged around a longitudinal axis, the longitudinal axis defining an axial direction; and a plurality of resilient segments that are circumferentially arranged around the longitudinal axis and are each alternately disposed with respect to each rigid segment, wherein the rigid segments and the resilient segments together circumscribing the longitudinal axis, and wherein each rigid segment has a radially inner surface that faces the longitudinal axis, a radially outer surface that faces away from the longitudinal axis, a first axially facing surface, and a second axially facing surface that faces away from the first axially facing surface, wherein the radially inner surfaces at least partially define an axial through hole that extends along the longitudinal axis;

wherein each of the resilient segments resiliently connects a pair of adjacent rigid segments, and wherein each resilient segment extends circumferentially between the corresponding pair of adjacent rigid segments to resiliently expand circumferentially when the rigid segments are moved radially outwardly to expand the backup ring, thereby circumferentially urging together adjacent rigid segments with the resilient segments; and a plurality of rigid support segments that are circumferentially arranged around the longitudinal axis and are each axially aligned with a corresponding resilient segment of the backup ring such that each of the rigid support segments at least partially overlaps the corresponding resilient segment in a stacked relationship in the axial direction and wherein each of the rigid support segments has a circumferential end that is radially and circumferentially fixed to a corresponding rigid segment such that when the rigid segments are moved radially outwardly to expand the backup ring each of the rigid support segments moves radially outwardly with the corresponding rigid segment.

2. The backup ring assembly of claim 1, wherein the first axially facing surface extends radially in an inclined manner relative to the longitudinal axis to form a camming surface that can be engaged by an inclined camming surface that when engaged with the camming surface moves the plurality of rigid segments radially outward and expands each of the plurality of resilient segments.

3. The backup ring assembly of claim 1, wherein the plurality of rigid segments are one-piece with the plurality of resilient segments.

4. The backup ring assembly of claim 1, wherein the resilient segment includes a plurality of cantilevered portions that is resiliently connected to each adjacent rigid segment.

5. The backup ring assembly of claim 1, wherein each resilient segment includes an undulating portion that circumferentially extends between the corresponding pair of adjacent rigid segments to form a plurality of radially outwardly opening loops in a plane perpendicular to the longitudinal axis and radially inwardly opening loops in a plane perpendicular to the longitudinal axis.

6. The backup ring assembly of claim 5, wherein each resilient segment includes an axially extending portion within each radially outwardly opening loop and within each radially inwardly opening loop.

7. The backup ring assembly of claim 6, wherein the axially extending portion within each radially outwardly opening loop and within each radially inwardly opening loop extends radially from an interior of their corresponding loop.

8. The backup ring assembly of claim 6, wherein the axially extending portion has a main portion disposed within the interior of the corresponding loop and the main portion extends radially to an end portion of the axial extending portion; and wherein the main portion has a circumferential width that is greater than the end portion.

9. The backup ring assembly of claim 1, wherein the backup ring is expandable anywhere from 1% to 30% from an unexpanded state to an expanded state.

10. The backup ring assembly of claim 1, wherein each rigid segment includes a circumferentially extending finger disposed radially inward of a corresponding resilient segment, and wherein the circumferentially extending finger is radially aligned with the resilient segment.

11. The backup ring assembly of claim 1, wherein each rigid segment includes a pair of circumferentially extending fingers that extend in circumferentially opposite directions and are each disposed radially inward of a corresponding resilient segment, and wherein each circumferentially extending finger is radially aligned with the corresponding resilient segment.

12. The backup ring assembly of claim 1, further including:

a plurality of resilient support segments that are circumferentially arranged around the longitudinal axis and are each alternately disposed with respect to each rigid support segment, wherein the rigid support segments and the resilient support segments together circumscribing the longitudinal axis, and wherein each of the resilient support segments resiliently connects a pair of adjacent rigid support segments, wherein each resilient support segment extends circumferentially between the corresponding pair of adjacent rigid support segments to resiliently expand circumferentially when the rigid support segments are moved radially outwardly, thereby circumferentially urging together adjacent rigid support segments with the resilient support segments.

13. The backup ring assembly of claim 1, wherein the backup ring is a first backup ring and the backup ring assembly further includes:

a second backup ring including:

a plurality of second rigid segments that are circumferentially arranged around the longitudinal axis; and a plurality of second resilient segments that are circumferentially arranged around the longitudinal axis and are each alternately disposed with respect to each second rigid segment, wherein the second rigid segments and the second resilient segments together circumscribing the longitudinal axis, and wherein each second rigid segment has a radially inner surface that faces the longitudinal axis, a radially outer surface that faces away from the longitudinal axis, a first axially facing surface, and a second axially facing surface that faces away from the first axially facing surface, wherein the radially inner surfaces of each second rigid segment at least partially define an axial through hole that extends along the longitudinal axis, wherein the first axially facing surface of each second rigid segment of the second backup ring faces away from the first backup ring; and wherein each of the second resilient segments resiliently connects a pair of adjacent second rigid segments, and wherein each second resilient segment extends circumferentially between the corresponding pair of adjacent second rigid segments to resiliently expand circumferentially when the second rigid segments are moved radially outwardly to expand the second backup ring, thereby circumferentially urging together adjacent second rigid segments with the second resilient segments; and a plurality of second rigid support segments that are circumferentially arranged around the longitudinal axis and are each axially aligned with a corresponding second resilient segment of the second backup ring such that each of the second rigid support segments at least partially overlaps the corresponding second resilient segment in a stacked relationship in the axial direction.

14. A tool assembly, including:

the backup ring assembly of claim 1;

a radially outwardly facing groove that is axially reducible and that is at least partially formed by a radially outwardly facing surface that circumscribes the longitudinal axis;

a sealing member that circumscribes the longitudinal axis and is at least partially disposed within the radially outwardly facing groove such that the sealing member is engageable with the radially outwardly facing surface;

wherein the backup ring assembly is disposed at least partially within the radially outwardly facing groove and engageable with an axially facing surface of the sealing member; and wherein when an axial thickness of the radially outwardly facing groove is reduced the sealing member is axially compressed and expands radially, and the backup ring assembly expands radially outwardly.

15. The backup ring assembly of claim 1, further including:

a dual layer support segment assembly that includes a plurality of rigid inner support segments and a plurality of rigid outer support segments that are circumferentially arranged around the longitudinal axis, wherein the plurality of rigid support segments is the plurality of rigid inner support segments, and wherein the plurality of rigid inner support segments is disposed axially between the rigid outer support segments and the backup ring.

16. The backup ring assembly of claim 1, wherein each resilient segment includes a spring that extends circumferentially between the corresponding pair of adjacent rigid segments to resiliently expand circumferentially when the rigid segments are moved radially outwardly to expand the backup ring, thereby circumferentially urging together adjacent rigid segments with the spring; and wherein each rigid segment includes a cavity that extends circumferentially from one circumferential end of the corresponding rigid segment to the other circumferential end, and at least a portion of each spring is disposed within corresponding adjacent cavities.

17. The backup ring assembly of claim 1, wherein the backup ring includes a surface treated layer to reduce friction and/or to protect against corrosion.

18. The backup ring assembly of claim 1, wherein the backup ring includes a chamfer at a radially outer end of the backup ring.

19. The backup ring assembly of claim 1, wherein each of the plurality of rigid support segments has a circumferential central portion that is radially and circumferentially fixed to the corresponding resilient segment.

20. A backup ring assembly, including:

a backup ring, comprising:

a plurality of rigid segments that are circumferentially arranged around a longitudinal axis, the longitudinal axis defining an axial direction; and a plurality of resilient segments that are circumferentially arranged around the longitudinal axis and are each alternately disposed with respect to each rigid segment, wherein the rigid segments and the resilient segments together circumscribing the longitudinal axis, and wherein each rigid segment has a radially inner surface that faces the longitudinal axis, a radially outer surface that faces away from the longitudinal axis, a first axially facing surface, and a second axially facing surface that faces away from the first axially facing surface, wherein the radially inner surfaces at least partially define an axial through hole that extends along the longitudinal axis;

wherein each of the resilient segments resiliently connects a pair of adjacent rigid segments, and wherein each resilient segment extends circumferentially between the corresponding pair of adjacent rigid segments to resiliently expand circumferentially when the rigid segments are moved radially outwardly to expand the backup ring, thereby circumferentially urging together adjacent rigid segments with the resilient segments;

a plurality of rigid support segments that are circumferentially arranged around the longitudinal axis and are each axially aligned with a corresponding resilient segment of the backup ring such that each of the rigid support segments at least partially overlaps the corresponding resilient segment in a stacked relationship in the axial direction; and a plurality of resilient support segments that are circumferentially arranged around the longitudinal axis and are each alternately disposed with respect to each rigid support segment, wherein the rigid support segments and the resilient support segments together circumscribing the longitudinal axis, and wherein each of the resilient support segments resiliently connects a pair of adjacent rigid support segments, wherein each resilient support segment extends circumferentially between the corresponding pair of adjacent rigid support segments to resiliently expand circumferentially when the rigid support segments are moved radially outwardly, thereby circumferentially urging together adjacent rigid support segments with the resilient support segments.

* * * * *